US007482922B2

(12) United States Patent
Yui et al.

(10) Patent No.: US 7,482,922 B2
(45) Date of Patent: Jan. 27, 2009

(54) ELECTRONIC DEVICE CONTROLLING APPARATUS AND ELECTRONIC DEVICE CONTROLLING METHOD

(75) Inventors: Yasuji Yui, Kanagawa (JP); Hiroyuki Matsumura, Kanagawa (JP); Akira Yaegashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 689 days.

(21) Appl. No.: 11/109,025

(22) Filed: Apr. 18, 2005

(65) Prior Publication Data

US 2005/0246746 A1 Nov. 3, 2005

Related U.S. Application Data

(63) Continuation of application No. 10/643,190, filed on Aug. 18, 2003, now Pat. No. 6,972,680.

(30) Foreign Application Priority Data

Aug. 19, 2002 (JP) ..... 2002-237900

(51) Int. Cl.
*G08B 21/00* (2006.01)

(52) U.S. Cl. ..... 340/540

(58) Field of Classification Search ..... 340/540, 340/5.2, 5.81, 286.02, 309.16, 5.1, 5.33; 725/11, 30, 78; 348/385.1, 553
See application file for complete search history.

(56) References Cited

U.S. PATENT DOCUMENTS

2002/0125993 A1* 9/2002 Gutta et al. ..... 340/5.52
2002/0178441 A1* 11/2002 Hashimoto ..... 725/11
2002/0199193 A1* 12/2002 Gogoi et al. ..... 725/46
2003/0182663 A1* 9/2003 Gudorf et al. ..... 725/110

* cited by examiner

*Primary Examiner*—Phung Nguyen
(74) *Attorney, Agent, or Firm*—Frommer Lawrence & Haug LLP; Thomas S. Frommer; Thomas F. Presson

(57) ABSTRACT

A movement made by a user viewing a television broadcast program, which is recorded on a hard disk device and read from the hard disk device to enable time shift viewing, is reproduced at a television (TV) set. The movement of the user is detected via a transmitting and receiving unit to which an electronic key card is held, and a reproduction position on a hard disk is recorded in a memory of a controlling apparatus main unit. A destination of the user is detected via a transmitting and receiving unit to which the electronic key card is held, and the broadcast signal is read from the stored reproduction position on the hard disk and then transferred to an electronic device at the destination. This enables a continuation of the broadcast program that was viewed to be viewed in a room at the destination.

2 Claims, 20 Drawing Sheets

FIG. 5

USER PERSONAL INFORMATION

| PERSONAL ID | NAME | HOUSE PRESENCE / HOUSE ABSENCE | VIEWING RESTRICTION LEVEL | SHOPPING RESTRICTION LEVEL | OTHERS |
|---|---|---|---|---|---|
| XXXXXXXX01 | (FATHER) | 1 | 5 | 5 | |
| XXXXXXXX02 | (MOTHER) | 1 | 5 | 5 | |
| XXXXXXXX03 | (FIRST CHILD) | 1 | 3 | 3 | |
| XXXXXXXX04 | (SECOND CHILD) | 1 | 2 | 0 | |
| ⋮ | ⋮ | ⋮ | ⋮ | ⋮ | ⋮ |

FIG. 6

ROOM PRESENCE MONITORING INFORMATION

| ROOM | PERSONAL ID | | | |
|---|---|---|---|---|
| ROOM A | 01 | 04 | | |
| ROOM B | | | | |
| ROOM C | 03 | | | |
| ROOM D | 02 | | | |
| OTHERS | | | | |
| | | | | |

21A TO 21E

ELECTRONIC DEVICE CONTROLLING APPARATUS AND ELECTRONIC DEVICE CONTROLLING METHOD

CROSS-REFERENCE TO RELATED APPLICATION

This application is a continuation application of U.S. patent application Ser. No. 10/643,190, filed Aug. 18, 2003, now U.S. Pat. No. 6,975,680, which is hereby incorporated by reference in its entirety herein.

BACKGROUND OF THE INVENTION

The present invention relates to an electronic device controlling apparatus and an electronic device controlling method for centralized control of electronic devices installed in rooms of a house, such as television receivers, for example.

It has become common to use in each house a plurality of so-called AV (Audio Visual) devices such as television receivers, VTRs (Video Tape Recorders), reproducing devices and recording and reproducing devices for DVD (Digital Versatile Disc), recording and reproducing devices using a hard disk, and the like.

For example, there have been an increasing number of houses where an AV device to be shared by family members is installed in a living room and an AV device for personal use by each family member is installed in each room, providing an environment where a television broadcast program, contents recorded on a VTR, a DVD, or a hard disk, and the like can be reproduced and viewed in any room.

In a house with a recording and reproducing device using a hard disk as a recording medium, a broadcast program is read and reproduced while the broadcast program is recorded on the hard disk, and thus so-called time shift viewing is realized through the processing of recording the broadcast program on the hard disk.

In the case of this time shift viewing, when a user leaves the room while viewing a broadcast program, the user performs a predetermined operation to continue recording but temporarily stop reproduction. When the user returns to the room, the user restarts reproduction of the broadcast signal reproduced from the recording medium at the time of leaving the room, and the user can thereby view the broadcast program without missing a part of the broadcast program.

Thus, there have been an increasing number of houses with an environment using various AV devices in a plurality of rooms to reproduce contents such as a broadcast program, a movie, or the like as required by each family member for viewing.

Even when an AV device is installed in each room of one house, as described above, the AV device in each room only functions independently in each room. It is difficult to organically connect and control the AV device installed in each room, and it has not been implemented.

Hence, in the case of the above-mentioned time shift viewing, the user always needs to return to the AV device by which the user viewed the broadcast program. When the user continues to view the broadcast program viewed in a living room to his/her room, for example, the user cannot view the broadcast program during a period of time taken to go from the living room to his/her room. That is, time shift viewing between AV devices is not realized.

While an AV device is installed in each room, a hard disk recording and reproducing device, a DVD player, or the like is not used at all times in each room. Therefore, by allowing a hard disk recording and reproducing device, a DVD player, or the like to be shared from each room, it is possible to construct an AV system in each house more inexpensively.

SUMMARY OF THE INVENTION

In view of the above, it is an object of the present invention to provide an electronic device controlling apparatus and an electronic device controlling method that make it possible to organically connect electronic devices such as AV devices and properly control each of the electronic devices individually.

In order to solve the above problem, there is provided an electronic device controlling apparatus according to an aspect of the present invention, the apparatus including: communicating means for communicating with each of a plurality of electronic devices; detecting means for detecting movement of a user using a content at one electronic device of the plurality of electronic devices at a position corresponding to the one electronic device; storing means for storing information indicating a reproduction position of the content being used at the one electronic device when the detecting means detects movement of the user; destination detecting means for detecting that the user has moved to a position corresponding to one electronic device of the plurality of electronic devices; and reproduction controlling means for controlling an electronic device for reproducing the content and the electronic device at a destination by the communicating means to reproduce the content from a position corresponding to the information indicating the reproduction position stored by the storing means and allow the content to be used at the electronic device at the destination when the destination detecting means detects that the user has moved.

With the electronic device controlling device, preferably, when the user using a content at one electronic device of the plurality of electronic devices moves, the detecting means detects the movement of the user, and the storing means stores information indicating a reproduction position of the content being used.

When the destination detecting means detects a destination of the user whose movement has been detected, the reproduction controlling means controls each electronic device by the communicating means to allow the content to be used at the electronic device at the destination from a position indicated by the information indicating the reproduction position of the content being used.

Thus, the plurality of electronic devices can be organically connected and controlled. For example, when the user of a content moves, the user can continue using the content used to an intermediate point via an electronic device at a destination of the user. That is, the content used to an intermediate point is transferred so as to follow the user, and can be used by any of the electronic devices.

Further, according to the present invention, there is provided an electronic device controlling apparatus, wherein preferably, the content is a broadcast signal, and the electronic device for reproducing the content records the content received and selected onto a recording medium and reproduces the content recorded on the recording medium in parallel with the recording processing, and when the detecting means detects movement of the user, the electronic device continues recording the content onto the recording medium without erasing an un-reproduced part of the content; the storing means stores, as the information indicating the reproduction position, information indicating a position corresponding to a reading position on the recording medium, on which the content is recorded, at a point in time when the detecting means detects the movement of the user; and the reproduction controlling means makes the content reproduced from the position on the recording medium on the basis of the information indicating the reproduction position stored by the storing means.

With the electronic device controlling apparatus, Preferably, the content is a broadcast signal, and the electronic device for reproducing the content records the content onto a recording medium to enable so-called time shift viewing, and reads and reproduces the content from the recording medium.

When the detecting means detects movement of the user using the content, the electronic device continues recording the broadcast signal as the content onto the recording medium, and the storing means stores, as the information indicating the reproduction position, information indicating a position corresponding to a position for reading the content from the recording medium at a point in time when the detecting means detects the movement of the user.

Thereafter, when the destination detecting means detects a destination of the user whose movement has been detected, the content can be used at the electronic device at the destination from the position based on the information indicating the reproduction position of the content that was used.

Thus, the plurality of electronic devices can be organically connected and controlled. The user can perform so-called time shift viewing of the content in both cases where the user returns to a position corresponding to an original electronic device and where the user moves to a position corresponding to another electronic device after leaving a room during use of the content.

BRIEF DESCRIPTION OF THE DRAWINGS

FIG. 5 is a diagram of assistance in explaining user personal information formed and managed in an EEPROM of the controlling apparatus main unit 2 shown in FIG. 4 or the like;

FIG. 6 is a diagram of assistance in explaining room presence monitoring information formed and managed in the EEPROM of the controlling apparatus main unit 2 shown in FIG. 4 or the like;

DETAILED DESCRIPTION OF PREFERRED EMBODIMENTS

An embodiment of an electronic device controlling apparatus and an electronic device controlling method according to the present invention will hereinafter be described with reference to the drawings.

First Embodiment

[Outline of a Home Network System]

Figure 1:
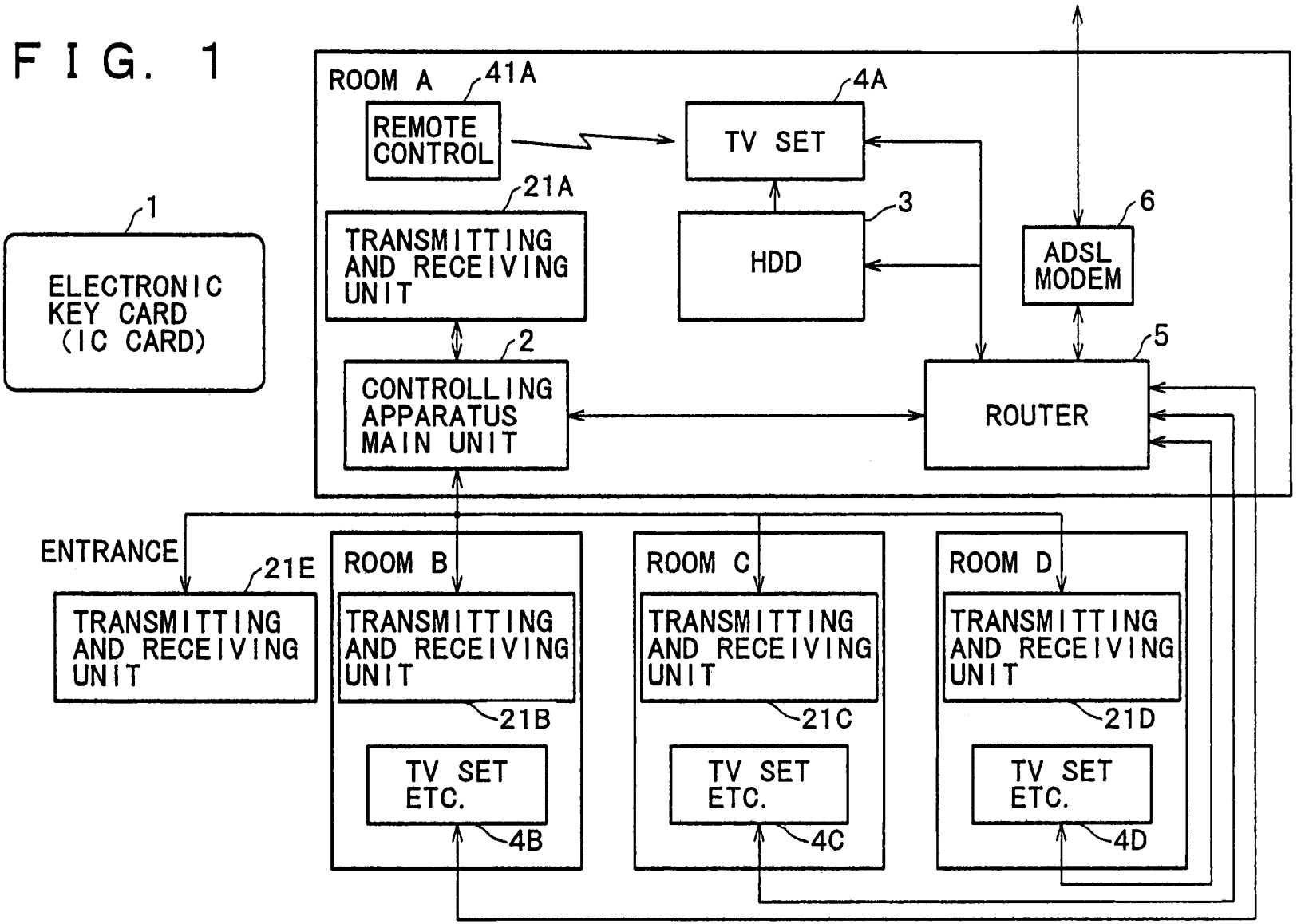
FIG. 1 is a diagram of assistance in explaining a home network system to which an embodiment of an electronic device controlling apparatus and an electronic device controlling method according to the present invention is applied.
Figure 2:
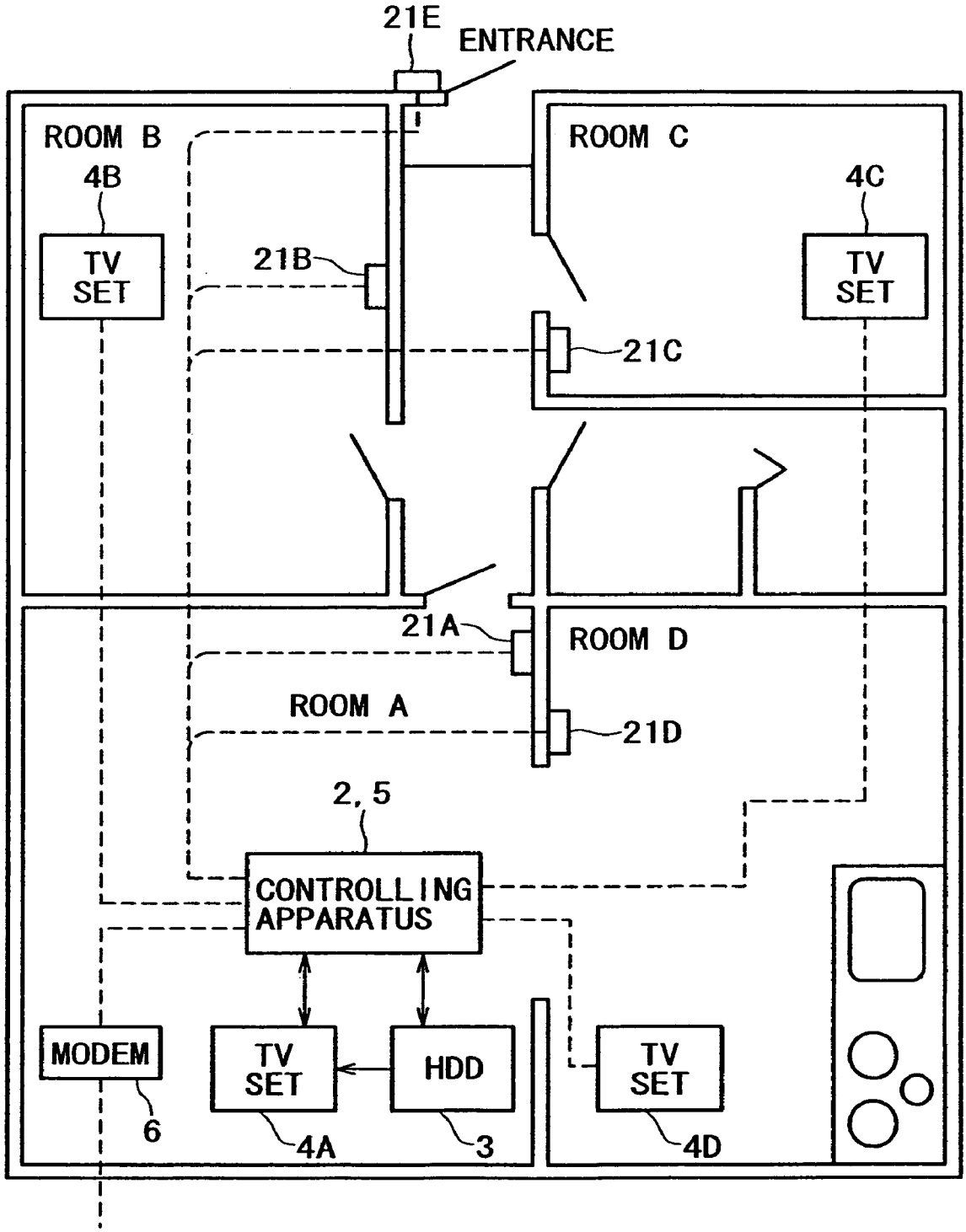
FIG. 2 is a diagram of assistance in explaining an example of an actual construction of the home network system shown in FIG. 1.

FIG. 1 and FIG. 2 are diagrams of assistance in explaining a home network system formed with a controlling apparatus including a controlling apparatus main unit 2 and transmitting and receiving units 21A to 21D, to which an electronic device controlling apparatus and an electronic device controlling method according to the present invention is applied. As shown in FIG. 1 and FIG. 2, in the first embodiment, television sets (hereinafter referred to as TV sets) 4A, 4B, 4C, and 4D each including a television receiver and a speaker, and the like are installed in four respective rooms A, B, C, and D.

While description in the following will be made supposing that the TV sets 4A, 4B, 4C, and 4D are installed in the respective rooms A, B, C, and D, it is possible to install various electronic devices such as a personal computer and other AV devices in each room and connect these devices via a router 5 or the like.

Installed in a room A are the controlling apparatus main unit 2; a hard disk device (described as an HDD (Hard Disk Drive) in the figures) 3 as a recording and reproducing device that has a function of receiving terrestrial broadcast and satellite broadcast and can record/reproduce terrestrial broadcast programs and satellite broadcast programs the router 5; and an ADSL (Asymmetric Digital Subscriber Line) modem 6 connected to a telephone line.

As shown in FIG. 1, the controlling apparatus main unit 2, the hard disk device 3, the ADSL modem 6, and the TV sets 4A, 4B, 4C, and 4D in the respective rooms are connected to each other via the router 5 installed in the room A. The controlling apparatus main unit 2, the hard disk device 3, the ADSL modem 6, and the TV sets 4A, 4B, 4C, and 4D in the respective rooms are each given a device ID to enable transmission and reception of data between devices with a receiving device specified and transmission and reception of data with all devices specified as receiving devices.

The controlling apparatus main unit 2 in the first embodiment can control the hard disk device 3, the TV sets 4A, 4B, 4C, and 4D in the respective rooms, and the like via the router 5, supply contents from the hard disk device 3 to a destination TV set, and perform other operations.

Further, the controlling apparatus main unit 2 is connected with the transmitting and receiving units 21A, 21B, 21C, 21D, and 21E installed in the rooms and on the outside of an entrance part, as will also be described later. These transmitting and receiving units 21A, 21B, 21C, 21D, and 21E are each intended to read personal identification information (hereinafter referred to as personal ID) of a holder of an electronic key card (IC card) 1. The electronic key card 1 stores the personal ID. The units 21A to 21E are also intended to write various information to the electronic key card 1.

As will also be described later, the electronic key card 1 is given to each member of a family of a house having the home network system constructed therein. The electronic key card 1 is used as a so-called card key and also used to register entering and leaving of each room, and has personal ID and the like recorded therein. Hence, there are different electronic key cards for different members of the family. For simplicity description, however, the electronic key card of each member will hereinafter be described as the electronic key card 1.

In the first embodiment, as shown in FIG. 2, the transmitting and receiving unit 21A is disposed in the vicinity of a door of the room A having the controlling apparatus main unit 2 installed therein. As shown in FIG. 2, the transmitting and receiving units 21B, 21C, and 21D are disposed in the vicinity of a door of the rooms B, C, and D, respectively. The transmitting and receiving unit 21E is disposed on the outside of the entrance.

Each of the transmitting and receiving units 21A to 21E and the electronic key card 1 can exchange data therebetween through non-contact communication using electromagnetic induction or radio waves.

In the home network system according to the first embodiment, entering of a room and leaving of a room of each individual holder of the electronic key card 1 is registered in the controlling apparatus main unit 2 through the electronic key card 1 and the transmitting and receiving units 21A to 21E. By realizing so-called time shift viewing in a different room, which allows a broadcast program to be viewed without missing of part of the program contents even when the broadcast program viewed in the room A is moved to the room B, for example, contents (video information and audio information) being viewed follow the movement of the user.

[Configuration of Electronic Devices Including the System]

Description will next be made of examples of configuration of the home network system according to the first embodiment including the electronic key card 1, the controlling apparatus main unit 2, the transmitting and receiving units 21A to 21E, the hard disk device 3, the TV set 4, and a remote control 41 of the TV set.

[Example of Configuration of the Electronic Key Card 1]

Figure 3A:
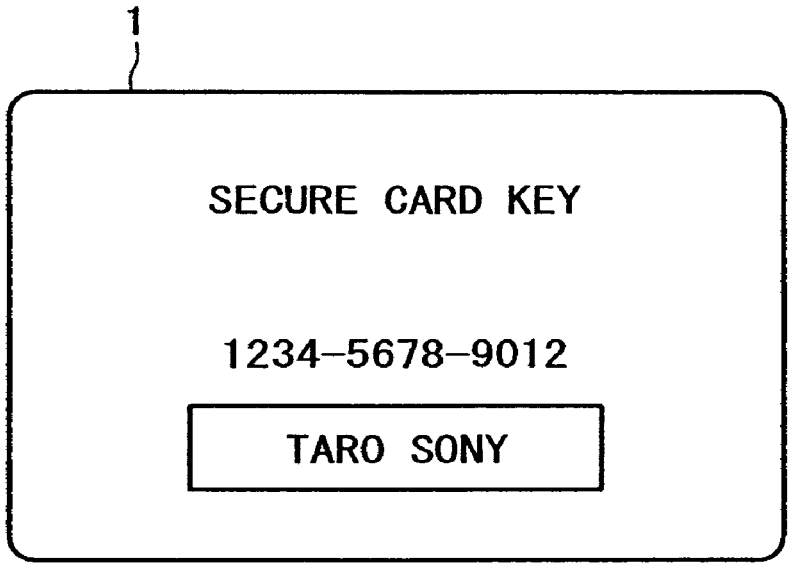
FIGS. 3A and 3B are diagrams of assistance in explaining an electronic key card (IC card) 1 used in the home network system shown in FIG. 1 and FIG. 2.
Figure 3B:
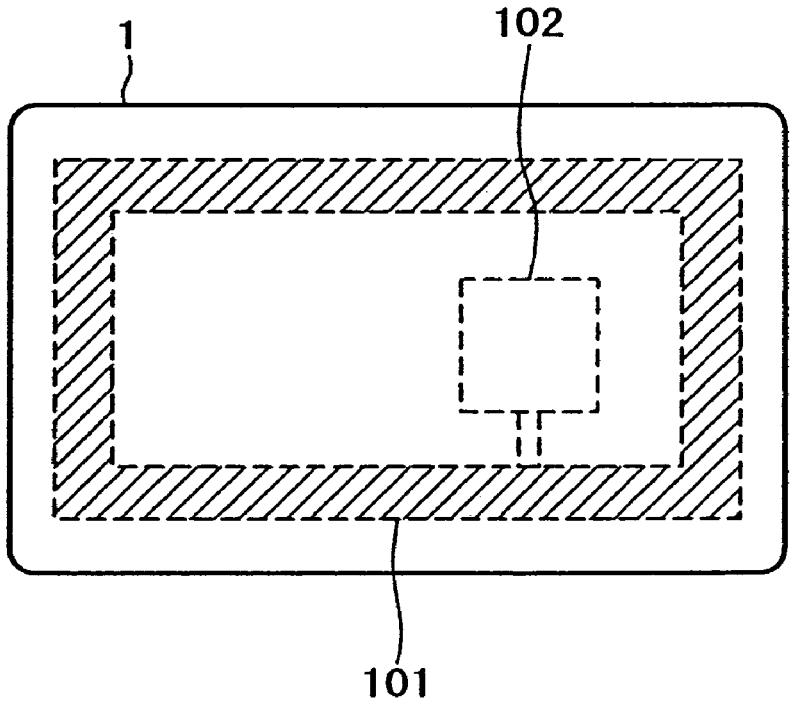

The electronic key card 1 will first be described. FIGS. 3A and 3B are diagrams of assistance in explaining an example of configuration of the electronic key card 1 used in the first embodiment. FIG. 3A shows a front side of the electronic key card 1. The front side of the electronic key card 1 shows a name and an ID number of the holder. FIG. 3B shows an example of internal configuration of the electronic key card 1. The electronic key card 1 includes an antenna 101 for electromagnetic induction for communication with a read/write unit of the transmitting and receiving units 21A to 21E to be described later, and an IC 102 for control.

The control IC 102 includes a CPU (Central Processing Unit) and a memory which stores the name, personal ID of the holder, and other necessary personal information of the holder. The personal information is formed so as to distinguish a father, a mother, children, and the like.

Times and a history of communications made by each holder with the transmitting and receiving units 21A to 21E, a history of leaving and entering of the house of each holder, and the like are written to the memory within the control IC 102. Incidentally, these pieces of history information are also stored in a predetermined memory in the controlling apparatus main unit 2

[Example of Configuration of the Controlling Apparatus Main Unit 2]

Figure 4:
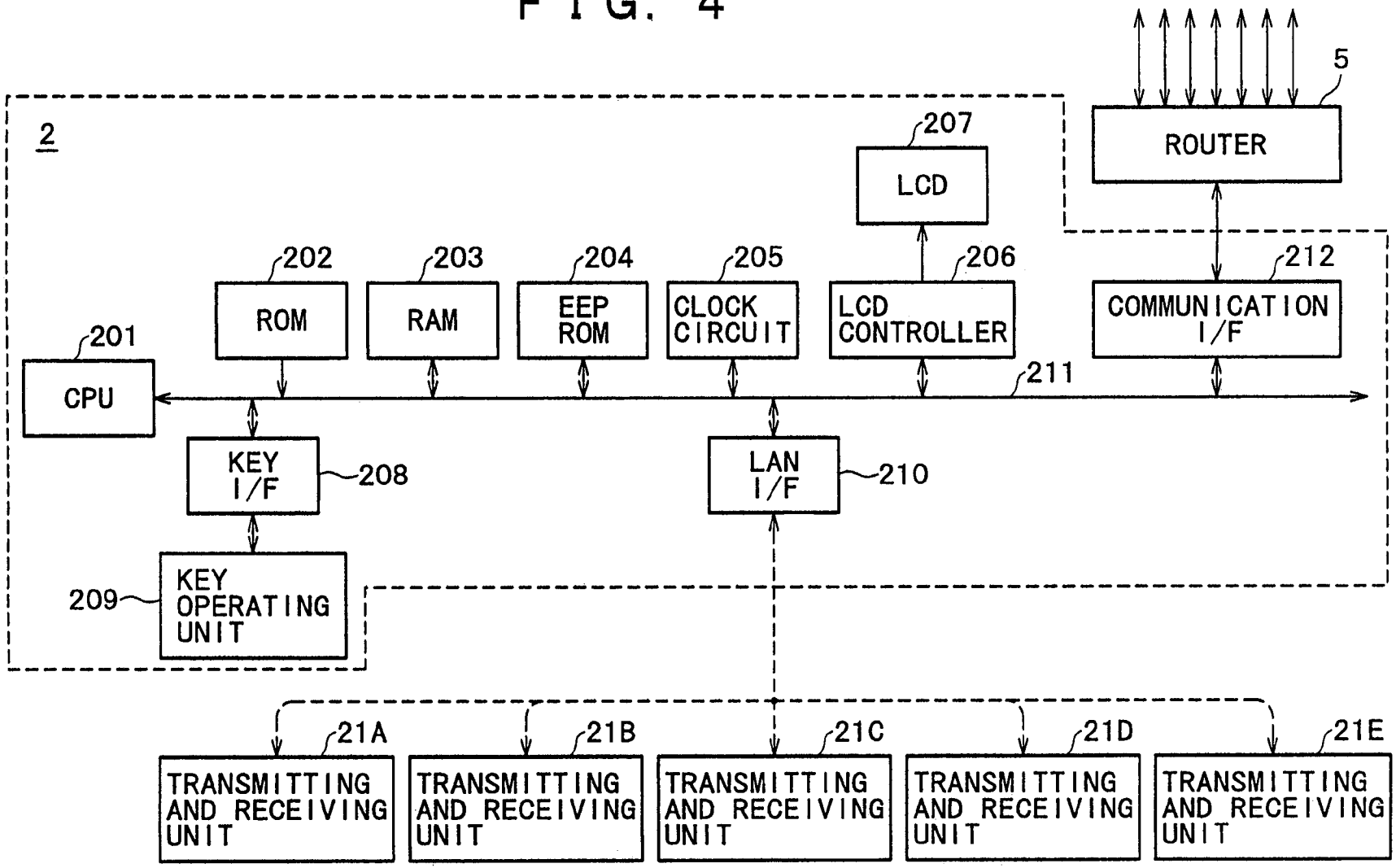
FIG. 4 is a diagram of assistance in explaining a controlling apparatus main unit 2 used in the home network system shown in FIG. 1 and FIG. 2.

An example of configuration of the controlling apparatus main unit 2 will next be described. FIG. 4 is a block diagram of assistance in explaining an example of configuration of the controlling apparatus main unit 2 according to the first embodiment. As shown in FIG. 4, the controlling apparatus main unit 2 according to the first embodiment is formed by connecting, via a CPU bus 211, a CPU 201, a ROM (Read Only Memory) 202, a RAM (Random Access Memory) 203, an EEPROM (Electrically Erasable and Programmable ROM) 204, a clock circuit 205, an LCD (Liquid Crystal Display) controller 206, a key interface (hereinafter abbreviated to a key I/F) 208, and a LAN interface (hereinafter referred to simply as a LAN I/F) 210.

Various data necessary for various programs and processing to be executed by the controlling apparatus main unit 2 according to the first embodiment are recorded in the ROM 202. The RAM 203 is mainly used as a work area for temporarily storing results of various works in progress and the like. The EEPROM 204 is a so-called nonvolatile memory in which stored information does not disappear even when power is shut down. As will also be described later, management information such as user personal information and room presence monitoring information, and other information such as various parameters are recorded in the EEPROM 204.

As shown in FIG. 4, the LAN I/F 210 converts data from the transmitting and receiving units 21A to 21E into data in a format that can be handled by the controlling apparatus main unit 2, and, conversely, converts data from the controlling apparatus main unit 2 into data in a format that can be handled by each of the transmitting and receiving units 21A to 21E.

As will also be described later, each of the transmitting and receiving units 21A to 21E includes a control unit including a CPU and the like, and has a device ID as signed to the transmitting and receiving unit. Data transmitted from each of the transmitting and receiving units 21A to 21E to the controlling apparatus main unit 2 has the device ID of the transmitting and receiving unit added thereto. The controlling apparatus main unit 2 can thereby determine which of the transmitting and receiving units 21A to 21E has transmitted data.

In a case where the controlling apparatus main unit 2 transmits a control signal and various data to a specific transmitting and receiving unit, on the other hand, the device ID of a target transmitting and receiving unit is added as destination information to the transmitting data, and then the data is transmitted. Thus, the controlling apparatus main unit 2 can transmit the data to only the target transmitting and receiving unit. Of course, the controlling apparatus main unit 2 can transmit common transmission data to each of the transmitting and receiving units 21A to 21E simultaneously by a so-called broadcasting method.

As shown in FIG. 4, the LCD controller 206 is connected with an LCD 207. Under control of the LCD controller 206, the LCD 207 displays various information such as a guidance message, a warning message, and the like. The key I/F 208 is connected with a key operating unit 209. The key operating unit 209 has a plurality of operating keys such as numeric keys, function keys, and the like. The controlling apparatus main unit 2 can receive various instruction inputs from a user through the key operating unit 209 and the key I/F 208.

Further, the controlling apparatus main unit 2 is connected to the router 5 via a communication interface (hereinafter abbreviated to a communication I/F) 212. The controlling apparatus main unit 2 can transmit a control signal to a target electronic device among the electronic devices such as the hard disk device 3, the TV sets 4A to 4D, and the ADSL modem 6 via the router 5 to control the electronic device. Also, the controlling apparatus main unit 2 can receive information from each electronic device via the router 5 and process the information.

As described above, user personal information and room presence monitoring information are recorded in the EEPROM 204 in the controlling apparatus main unit 2 according to the first embodiment. FIG. 5 is a diagram of assistance in explaining the user personal information. The user personal information is provided to record personal information of each family member of the house where the home network according to the first embodiment is formed, and the user personal information corresponds to a so-called user personal master.

The user personal information in the first embodiment includes predetermined and set information such as personal ID, viewing restriction level, and shopping restriction level. The user personal information also includes information such as a house presence/house absence flag updated according to a state at the present time. As described above, the personal ID differs for each individual constituent member forming the family so as to enable identification of each individual constituent member.

The personal ID in the case of the example shown in FIG. 5 includes a ten-digit number, for example. The ten digits includes the first eight digits representing family common ID common to the family and the next two digits representing personal ID unique to each person. Of course, the personal ID can be set uniquely with various characters such as a number formed by a totally different number of digits, the alphabet, symbols, and the like even among constituent members forming the same family.

The viewing restriction level is information for restricting broadcast programs allowed to be viewed. The viewing restriction level in the first embodiment can be set to any of six levels from level 5 with no restriction to level 0 allowing only programs for infants, for example. The shopping restriction level restricts an allowable purchase price at the time of shopping on the Internet. The shopping restriction level in the first embodiment can be set to any of six levels from level 5 with no restriction to level 0 allowing no shopping, for example.

Various other information, such as age, code number, and the like, of each constituent member forming the family can be preregistered in the user personal information.

The house presence/house absence flag is flag information to know whether a constituent member of the family is present in the house or absent from the house. The house presence/house absence flag is updated on the basis of personal ID read by the transmitting and receiving unit 21E and transmitted to the controlling apparatus main unit 2 when the user holds the electronic key card 1 to the transmitting and receiving unit 21E disposed on the outside of the entrance.

The room presence monitoring information is also formed in the EEPROM 204. FIG. 6 is a diagram of assistance in explaining the room presence monitoring information. The room presence monitoring information is information for monitoring in which room a person present in the house at the present time. There being four rooms A, B, C, and D in the first embodiment, updating room presence are performed by holding the electronic key card 1 to the transmitting and receiving units 21A to 21D at the time of entering the rooms, and updating room absence are performed by holding the electronic key card 1 to the transmitting and receiving units at the time of leaving the rooms.

Incidentally, as to whether the user is entering or leaving a room, by matching information read from the electronic key card 1 via the transmitting and receiving unit 21A to 21D with the room presence monitoring information shown in FIG. 6, it is possible to determine that the user is entering the room when there is no matching information and that the user is leaving the room when there is matching information.

In the example shown in FIG. 6, a number of the last two digits of personal ID allowing identification of each person of the family is used to monitor which room each person is present. The example shown in FIG. 6 indicates presence of a person having a personal ID of XXXXXXXX01 (father) and a person having a personal ID of XXXXXXXX04 (second child) in the room A. The example shown in FIG. 6 also indicates presence of a person having a personal ID=XXXXXXXX03 (first child) in the room C and presence of a person having a personal ID=XXXXXXXX02 (mother) in the room D.

When a family member is present in the house but has not held the electronic key card 1 to the transmitting and receiving units 21A to 21D of the rooms, the personal ID of the person is written to a section of others, for example, to indicate that there is a family member who is not present in any of the rooms. This can be detected by matching the personal. IDs of persons whose house presence/house absence flag of the user personal information indicates a state of presence in the house with the personal IDs of the room presence monitoring information.

The controlling apparatus main unit 2 can also grasp and monitor a current state of operation of electronic devices in each room. For example, the controlling apparatus main unit 2 performs communication with the TV sets 4A to 4D and the hard disk device 3 installed in the rooms via the router 5, and can thereby know and monitor a state of each electronic device.

As will also be described later in detail, the controlling apparatus main unit 2 detects the entering and leaving of rooms of each family member, and controls the hard disk device 3 and target TV sets via the router according to states of the hard disk device 3 and the TV sets 4A to 4D, thereby enabling not only ordinary time shift viewing on the same device but also time shift viewing on different TV sets.

[Example of Configuration of the Transmitting and Receiving Units 21A to 21E]

Description will next be made of an example of configuration of the transmitting and receiving units 21A to 21E for allowing detection of leaving and entering of the house and entering and leaving of each room of a family member by reading information from the electronic key card 1.

Figure 7:
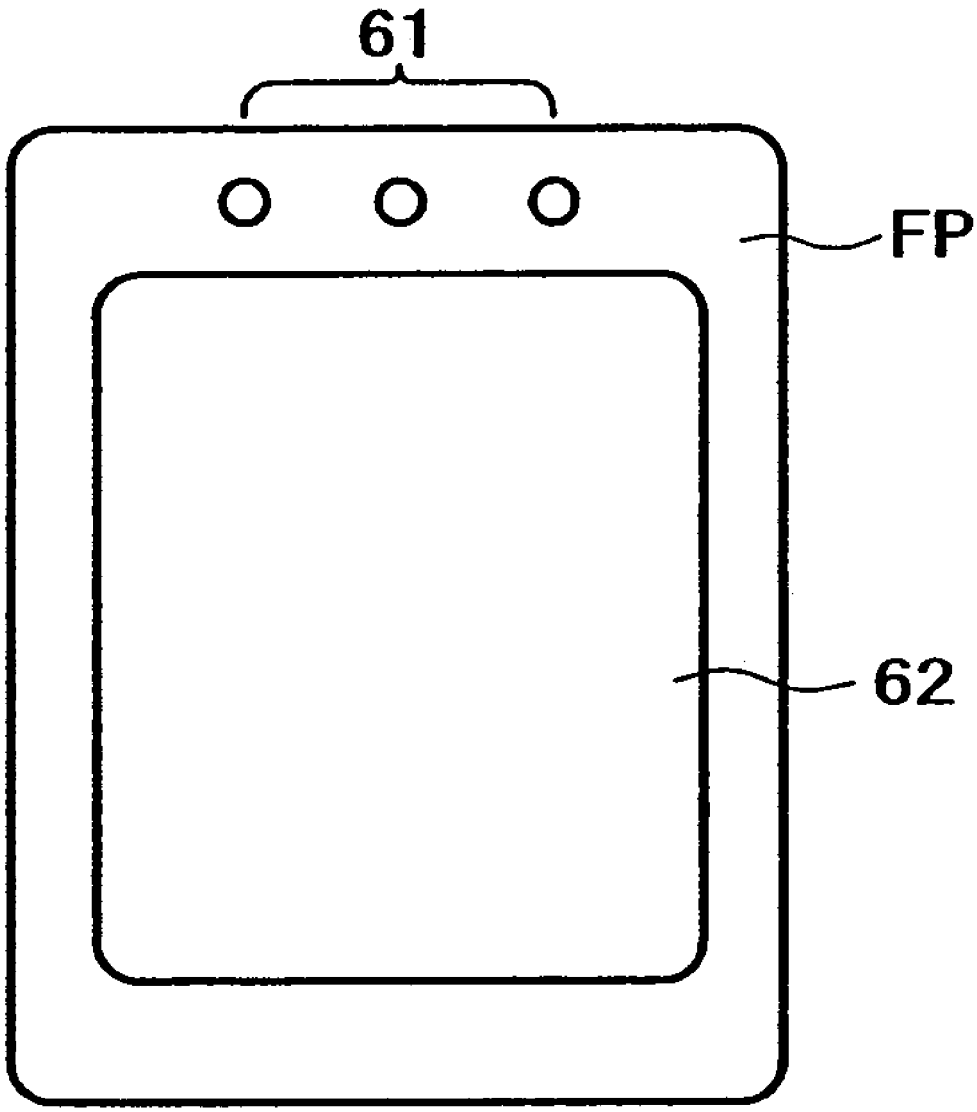
FIG. 7 is a diagram of assistance in explaining an external appearance of a transmitting and receiving unit connected to the controlling apparatus main unit 2 used in the home network system shown in FIG. 1 and FIG. 2.
Figure 8:
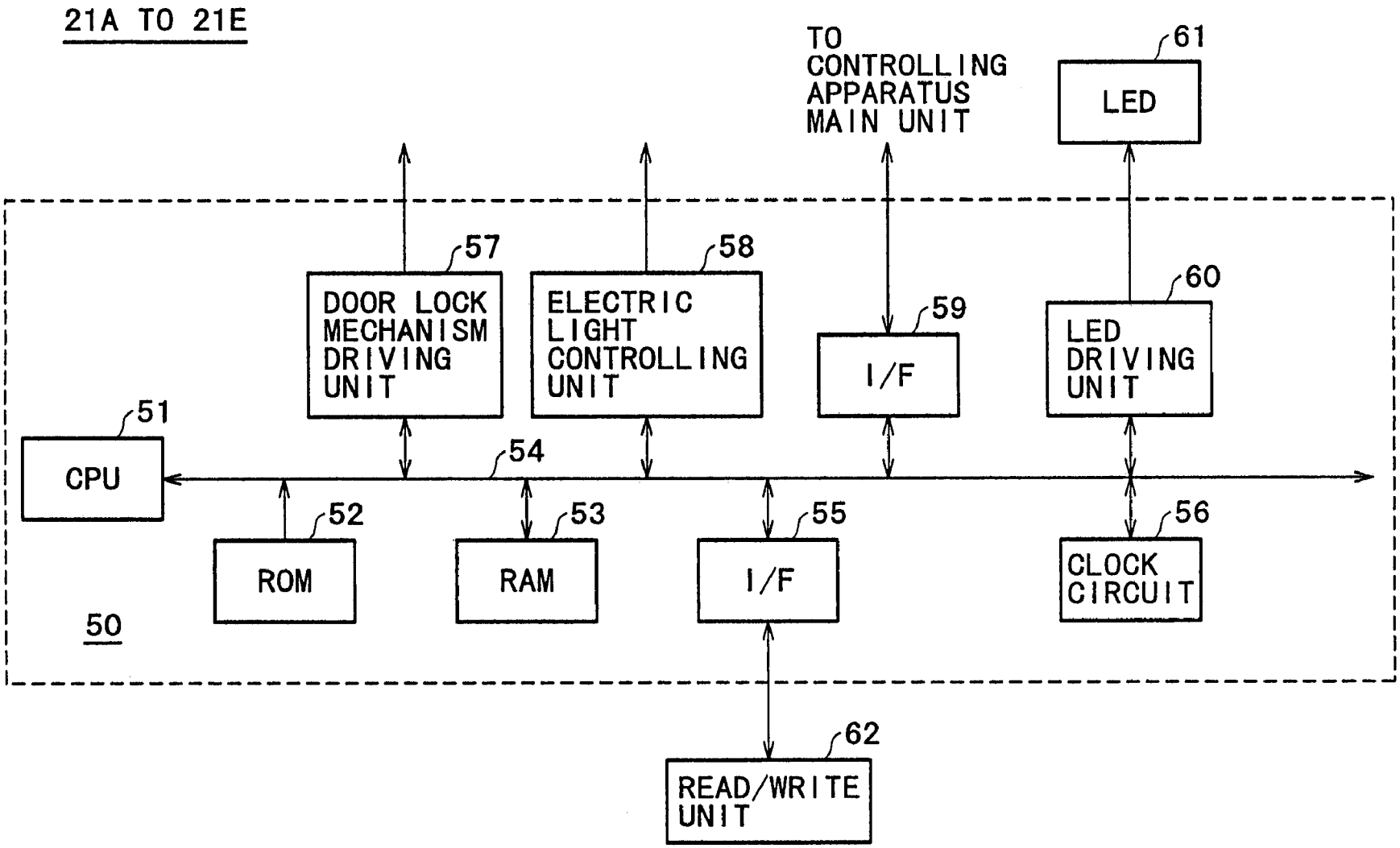
FIG. 8 is a diagram of assistance in explaining a configuration of the transmitting and receiving unit connected to the controlling apparatus main unit 2 used in the home network system shown in FIG. 1 and FIG. 2.

FIG. 7 is a diagram of assistance in explaining an external appearance of the transmitting and receiving unit 21A to 21E. FIG. 8 is a block diagram of assistance in explaining a configuration of the transmitting and receiving unit 21A to 21E. As shown in FIG. 7, an LED unit 61 having a plurality of LEDs (Light Emitting Diodes), which notify the user of a state of data reading and the like, and a read/write unit 62 are provided on a front panel surface FP.

The front panel surface FP of the transmitting and receiving units 21A to 21E is of a rectangular shape as with the electronic key card 1, and is somewhat larger in size than the electronic key card 1 for high-reliability communication with the electronic key card 1.

As shown in FIG. 8, each of the transmitting and receiving units 21A to 21E has a control unit 50 of a configuration of a microcomputer, in which a CPU 51, a ROM 52, and a RAM 53 are connected to each other via a CPU bus 54. The control unit 50 is connected with a clock circuit 56, a door lock mechanism driving unit 57, an electric light controlling unit 58, and an LED driving unit 60.

The ROM 52 stores data necessary for programs and processing to be executed by the control unit 50 of the transmitting and receiving unit 21A to 21E, a device ID unique to each of the transmitting and receiving units 21A to 21E, and the like. The RAM 53 is mainly used as a work area for temporarily storing results of work in progress and the like. Incidentally, in addition to the ROM 52 and the RAM 53, a nonvolatile memory such as an EEPROM or the like may be provided to store the device ID unique to each of the transmitting and receiving units 21A to 21E, parameters that can be set and changed, and the like.

Further, the control unit 50 is connected with the read/write unit 62 via an I/F 55. The read/write unit 62 can read data stored in the electronic key card 1 held to the read/write unit 62 by action of electromagnetic induction and then supply the data to the control unit 50, and write data from the control unit 50 to the electronic key card 1.

Further, the control unit 50 can transmit and receive data to and from the controlling apparatus main unit 2 via an I/F 59. Also, the control unit 50 can control the turning on, turning off, blinking, and the like of the LED 61 for each of the plurality of LEDs by controlling the LED driving unit 60.

The lock mechanism driving unit 57 in the first embodiment is provided only for the transmitting and receiving unit 21E installed outdoors at the entrance part. The door lock mechanism driving unit 57 can release a lock mechanism automatically when authentication is confirmed, as will also be described later.

Of course, it is possible to restrict entering and leaving of each room at times of entering and leaving of each room by disposing a lock mechanism at a door portion of each room in the house, providing the lock mechanism driving unit 57 also for the transmitting and receiving unit 21A to 21D at the door portion of each room in the house, and disposing a transmitting and receiving unit including the lock mechanism driving unit 57 also on the outside of the door portion of each room in the house.

When the electronic key card 1 is held to the read/write unit 62 of the transmitting and receiving unit 21E at the entrance, the read/write unit 62 reads data such as personal ID recorded in the electronic key card 1 and then supplies the data to the control unit 50 via the I/F 55, and also writes present date information and present time information obtained from the clock circuit 56 and supplied from the control unit 50 as a history item to a predetermined memory area in the memory of the electronic key card 1.

The control unit 50 then supplies the device ID of the transmitting and receiving unit and the personal ID data from the read/write unit 62 to the controlling apparatus main unit 2 via the I/F 59. In response to this the controlling apparatus main unit 2 determines on the basis of the data from the transmitting and receiving unit 21E whether the holder of the electronic key card 1 held to the read/write unit 62 of the transmitting and receiving unit 21E is a valid holder registered in advance in the controlling apparatus main unit 2, and then transmits a result of the determination to the transmitting and receiving unit 21E as the destination. The transmitting and receiving unit 21E thus captures the result of the determination via the I/F 59.

When the control unit 50 of the transmitting and receiving unit 21E obtains a result of the determination from the controlling apparatus main unit 2 indicating that the person holding the electronic key card 1 to the read/write unit 62 is a valid holder, the control unit 50 controls the door lock mechanism driving unit 57 to release the door lock and thereby allow entrance of the holder into the house.

In this case, the control unit 50 also compares an electric light illumination set time preset in the RAM 53 with a present time of the clock circuit 56. When the present time is within the electric light illumination set time, the control unit 50 controls the electric light controlling unit 58 to automatically turn on an electric light at least at the entrance part from which the holder is allowed to enter. Incidentally, the electric light can be automatically turned off at a certain time after being turned on, or the electric light can be turned off in response to operation of a light switch by the user.

The control unit 50 controls the LED driving unit 60 to notify the user that data has been read successfully or has not been read successfully from the electronic key card 1 from the electronic key card 1 by turning on, turning off, blinking, or the like of the LED 61. The control unit 50 also controls the LED driving unit 60 to notify the user of a result of the determination from the controlling apparatus main unit 2 indicating whether the user is a valid holder by turning on, turning off, or blinking of the LED 61.

The controlling apparatus main unit 2 knows who has returned home on the basis of the personal ID from the transmitting and receiving unit 21E, and updates the house presence/house absence flag of the user personal information shown in FIG. 5. The controlling apparatus main unit 2 can thus monitor the house presence/house absence of each family member.

On the other hand, when the electronic key card 1 is held to the read/write unit 62 of each of the transmitting and receiving units 21A to 21D other than the transmitting and receiving unit 21E at the entrance part, as described above, the read/write unit 62 can read necessary information such as personal ID from the electronic key card 1 held to the read/write unit 62 by action of electromagnetic induction, add the device ID of the transmitting and receiving unit to the information, and then transmit the information to the controlling apparatus main unit 2 via the I/F 59.

The controlling apparatus main unit 2 can thereby detect who has entered which room or who has left which room. The room presence monitoring information described with reference to FIG. 6 is updated with this and thus managed.

Also, in this case, the control unit 50 controls the electric light controlling unit 58 to turn on an electric light of the room that a user has entered on the basis of the room presence monitoring information formed in the EEPROM 204 of the controlling apparatus main unit 2. More specifically, when the room presence monitoring information determines that there is no other person in the same room, that the present time is within the electric light illumination set time by comparing the present time of the clock circuit 56 with the electric light illumination set time preset in the RAM 53, and that the electric light of the room that the user has entered is not turned on, the control unit 50 controls the electric light controlling unit 58 to turn on the electric light.

Also, at a time of leaving the room, the control unit 50 controls the electric light controlling unit 58 to turn off the electric light of the room that the user has left on the basis of the room presence monitoring information formed in the EEPROM 204 of the controlling apparatus main unit 2. More specifically, when the room presence monitoring information determines that there is no other person in the same room, that the present time is other than the electric light illumination set time by comparing the present time of the clock circuit 56 with the electric light illumination set time preset and stored in the RAM 53, and that the electric light of the room that the user entered is turned on, the control unit 50 controls the electric light controlling unit 58 to turn off the electric light. Of course, the electric light can be turned on and turned off in response to operation of a light switch by the user.

Thus, the transmitting and receiving units 21A to 21E each read the data recorded in the electronic key card 1 held to the read/write unit 62, and then transmit the data to the controlling apparatus main unit 2. The controlling apparatus main unit 2 can thereby monitor correctly who has returned home and who is present in which room as described above.

Incidentally, as to whether the user is absent from the house, a transmitting and receiving unit is provided also on the inside of the entrance, for example, and the electronic key card 1 of the user is held to the transmitting and receiving unit provided on the inside of the entrance at a time of leaving the house, whereby house absence registration can be performed. Alternatively, the electronic key card 1 is held to the transmitting and receiving unit 21E disposed on the outside of the entrance also at the time of leaving the house, whereby house absence registration can be performed.

In the latter case, when the door lock is released manually from the inside, for example, it is determined that the user is leaving the house. The personal ID from the electronic key card 1 held to the transmitting and receiving unit 21E is used for house absence registration, and not used for house presence registration to release the lock at a time of returning home, whereby house absence registration can be performed. In this case, the lock mechanism may be an automatic lock mechanism, or switching between unlocking and locking may be performed each time authentication using the personal ID of the electronic key card 1 is performed.

The embodiment described below employs the example of the latter case, that is, a case where the transmitting and receiving unit 21E disposed on the outside of the entrance is used for both house absence registration and house presence registration. Also, the embodiment will be described below supposing that the door lock is released after authentication and is set automatically.

[Example of Configuration of the Hard Disk Device 3]

Description will next be made of an example of configuration of the hard disk device 3 capable of providing contents to the TV set 4A and to the TV sets 4B to 4D in the respective rooms via the router 5, as shown in FIG. 1.

Figure 9:
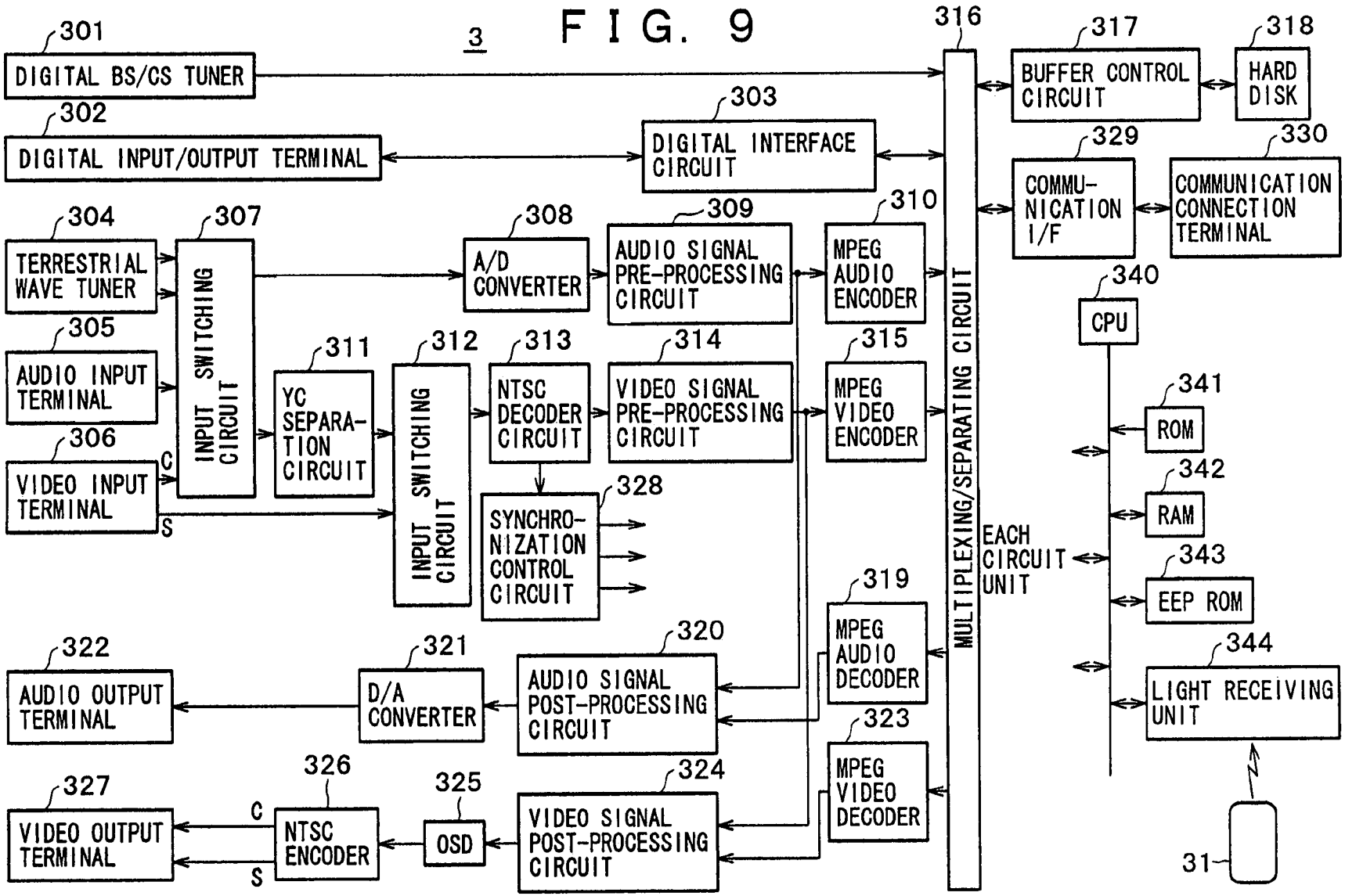
FIG. 9 is a diagram of assistance in explaining a hard disk device 3 used in the home network system shown in FIG. 1 and FIG. 2.

FIG. 9 is a block diagram of assistance in explaining an example of configuration of the hard disk device 3 in the first embodiment. A CPU 340 in FIG. 9 accesses a ROM 341, a RAM 342, and an EEPROM 343 via a host bus as required, and controls the whole of the hard disk device 3.

As shown in FIG. 9, the host bus is connected with a light receiving unit 344 for receiving an infrared remote control signal. The light receiving unit 344 can receive an infrared remote control signal from a remote control 31, convert the infrared remote control signal into an electric signal, and then supply the electric signal to the CPU 340. The CPU 340 can thereby control various parts to perform processing corresponding to an instruction supplied from a user via the remote control 31 and make various settings in the EEPROM 343, for example.

Various data necessary for various programs and processing to be executed by the hard disk device 3 in the first embodiment is recorded in the ROM 341. The RAM 342 is mainly used as a work area for temporarily recording results of processing in progress and the like. The EEPROM 343 is a so-called nonvolatile memory for storing and retaining data that needs to be retained even after power is shut down, for example various setting data and the like.

The hard disk device 3 in the first embodiment shown in FIG. 9 has a digital BS/CS tuner 301 and a digital input/output terminal 302 as a digital input terminal part, and has a terrestrial wave tuner 304, an analog audio input terminal 305, and an analog video input terminal 306 as an analog input terminal part.

The hard disk device 3 uses the digital input/output terminal 302 as a digital output terminal part, and has an analog audio output terminal 322 and an analog video output terminal 327 as an analog output terminal part. The hard disk device 3 further includes a communication connection terminal 330 to send and receive various data via a communication network such for example as the Internet.

The hard disk device 3 shown in FIG. 9 can record a digital video signal and a digital audio signal received via the above-mentioned digital input terminal part onto a hard disk 318, output the digital video signal and the digital audio signal via the digital output terminal part, and convert the digital video signal and the digital audio signal into analog signals and then output the analog signals.

Further, the hard disk device 3 shown in FIG. 9 can output an analog video signal and an analog audio signal received via the above-mentioned analog input terminal part via the analog output terminal part, and convert the analog video signal and the analog audio signal into digital signals to record the digital signals onto the hard disk 318 or output the digital signals via the digital output terminal part.

Further, the hard disk device 3 can record data received via the above-mentioned communication connection terminal 330 onto the hard disk 318, digitally output the data, and, when the received data is video data and audio data, convert these pieces of data into analog signals and then output the analog signals via the analog output terminal part.

[Use of Digital Input]

Description will be made of an operation of the hard disk device 3 in the first embodiment when the hard disk device 3 is supplied with information via the above-mentioned input terminal parts. Description will first be made of an operation of the hard disk device 3 when the hard disk device 3 receives a BS digital broadcast signal or a CS digital broadcast signal via the digital BS/CS tuner 301, and records the BS digital broadcast signal or the CS digital broadcast signal onto the hard disk 318 and outputs the BS digital broadcast signal or the CS digital broadcast signal in an analog form.

Though not shown in the figure, a parabolic antenna for receiving a digital broadcast signal from a satellite is connected to the digital BS/CS tuner 301. The digital BS/CS tuner 301 receives and selects a target digital broadcast signal on the basis of a channel selection control signal. The control signal, which is supplied from the CPU 340, is corresponding to an instruction for channel selection from a user. Then, the tuner 301 supplies the received and selected digital broadcast signal to a multiplexing/separating circuit 316.

The digital broadcast signal is in a form of a so-called TS (Transport Stream) signal obtained by packetizing image data (video data) and sound data (audio data) for constructing a broadcast program, and various other data together with various control data such as channel selection information referred to as PSI (Program Specific Information), EPG (Electronic Program Guide) data for forming an electronic program guide table and the like, and multiplexing the packetized data for transmission in each channel as a program transmission path.

An identifier (ID) is added to each packet. The identifier makes it possible to extract PSI data and EPG data, and extract image packets and sound packets for constructing the same program.

The multiplexing/separating circuit 316 extracts PSI and EPG data from the TS signal from the digital BS/CS tuner 301, and then supplies the PSI and EPG data to the CPU 340 to allow program selection. Also, the multiplexing/separating circuit 316 forms an electronic program guide table and then outputs the electronic program guide table for display in response to an instruction from a user, thus allowing program selection, unattended recording, and the like through the electronic program guide table.

When an instruction to record a selected program is given, the multiplexing/separating circuit 316 extracts video packets and audio packets of the target program selected by a user from the TS signal from the digital BS/CS tuner 301 and forms a new TS signal including the video packets and audio packets and necessary control data. The multiplexing/separating circuit 316 records the new TS signal onto the hard disk 318 via a buffer control circuit 317.

At the same time, the multiplexing/separating circuit unit 316 forms a video ES (Elementary Stream) from the video packets of the target program extracted from the TS signal from the digital BS/CS tuner 301 and then supplies the video ES to an MPEG (Moving Picture Experts Group) video decoder 323. The multiplexing/separating circuit 316 also forms an audio ES (Elementary Stream) from the audio packets of the target program extracted from the TS signal from the digital BS/CS tuner 301 and then supplies the audio ES to an MPEG audio decoder 319.

The MPEG audio decoder 319 decodes the audio ES supplied thereto, thereby obtains baseband audio data, and then supplies the baseband audio data to an audio signal post-processing circuit 320. The MPEG video decoder 323 decodes the video ES supplied thereto, thereby obtains baseband video data, and then supplies the baseband video data to a video signal post-processing circuit 324.

The video signal post-processing circuit 324 performs switching between the video data from the MPEG video decoder 323 and video data from a video signal pre-processing circuit 314 to be described later, screen synthesis, filter processing, and the like. Then, the circuit 324 supplies the video data after the processing to an OSD (On Screen Display) circuit 325.

The OSD circuit 325 generates graphics and text data for screen display, performs processing for superimposing the generated graphics and text data on the video data supplied to the OSD circuit 325, processing for partial display of the generated graphics and text data, or the like. Then, the circuit 325 supplies the video data after the processing to an NTSC encoder 326.

The NTSC encoder 326, converts the video data (component digital signals) supplied thereto into a YC signal, performs D/A conversion, generates an analog composite video signal C and an analog separate video signal S, and then outputs each of the analog composite video signal C and the analog separate video signal S through an output terminal 327 for an analog video signal.

In the meantime, the audio signal post-processing circuit 320 performs switching between the audio data from the MPEG audio decoder 319 and audio data from an audio signal pre-processing circuit 309, filter processing, fade processing, speech speed conversion processing, and the like and then supplies the audio data after the processing to an audio D/A converter 321. The audio D/A converter 321 converts the audio data supplied thereto into an analog audio signal and then outputs the analog audio signal through an output terminal 322 for an analog audio signal.

The TV set 4A, for example, is connected in a stage succeeding the analog audio output terminal 322 and the analog video output terminal 327. Sound corresponding to the analog audio signal outputted through the analog audio output terminal 322 is emitted from the speaker of the TV set 4A. An image corresponding to the analog video signal outputted through the analog video output terminal 327 is displayed on a display screen of the TV set 4A.

Thus, the hard disk device in the first embodiment can extract video data and audio data of a target program from a digital broadcast signal received and selected via the digital BS/CS tuner 301, record the video data and audio data of the target program onto the hard disk 318, and at the same time, form an analog video signal and an analog audio signal and output the analog video signal and the analog audio signal. That is, the hard disk device makes it possible to view the target program provided as the digital broadcast signal while recording the program onto the hard disk 318.

Also, as described above, a TS signal newly formed in the multiplexing/separating circuit 316 can be supplied to external devices such as the TV sets 4B to 4D in the other rooms, another recording device, a personal computer and the like via a digital interface circuit 303, the digital input/output terminal 302, and the router 5. In this case, the digital interface circuit 303 converts the digital signal supplied thereto into a digital signal in a form adapted to the external device and then outputs the digital signal.

Conversely, the hard disk device can for example receive via the digital input/output terminal 302 a digital signal supplied via a digital interface such as an IEEE 1394 digital interface or the like from an external device or the like, record the digital signal onto the recording medium 318, and form an analog video signal and an analog audio signal and then output the analog video signal and the analog audio signal.

Specifically, the digital signal is supplied through the digital input/output terminal 302 to the digital interface circuit 303. The digital interface circuit 303 subjects the digital signal supplied thereto to processing for format conversion so that the digital signal is adapted to a system used by the image processing device in the first embodiment, thereby generates a TS signal, and then supplies the TS signal to the multiplexing/separating circuit 316.

The multiplexing/separating circuit 316 further analyzes and generates a control signal and the like and then forms a TS signal in a format for recording on the hard disk 318. The multiplexing/separating circuit 316 can record the TS signal onto the hard disk 318 via the buffer control circuit 317, as described above.

The multiplexing/separating circuit 316 forms a video ES and an audio ES from the TS signal supplied from the digital interface circuit 303 and then supplies the video ES and the audio ES to the MPEG video decoder 323 and the MPEG audio decoder 319. Thereby, as described above, an analog video signal and an analog audio signal can be formed and then outputted.

[Use of Analog Input]

Description will next be made of an operation of the hard disk device 3 when the hard disk device 3 receives an analog signal input via the terrestrial wave tuner 304, the analog audio input terminal 305, and the analog video input terminal 306, records the analog signal onto the hard disk 318, and outputs the analog signal in an analog form.

The terrestrial wave tuner 304 receives, selects, and demodulates an analog terrestrial broadcast signal, obtains an analog video signal (composite signal) and an analog audio signal, and then supplies the analog video signal and the analog audio signal to an input switching circuit 307. Similarly, a composite video signal C and an audio signal from the outside are supplied to the input switching circuit 307.

The input switching circuit 307 selects and outputs a target signal according to a control signal from the CPU 340. Specifically, the input switching circuit 307 switches between the output of the analog video signal and the analog audio signal from the terrestrial wave tuner 304 and the output of the analog audio signal and the analog video signal from the analog audio input terminal 305 and the analog video input terminal 306.

Of the signals outputted from the input switching circuit 307, the analog audio signal is supplied to an A/D converter 308, and the analog video signal (composite signal) is supplied to a YC separation circuit 311. The YC separation circuit 311 subjects the analog video signal supplied thereto to YC separation, that is, separates the analog video signal into a luminance signal Y and a color-difference signal C, and then supplies the luminance signal Y and the color-difference signal C to an input switching circuit 312. The input switching circuit 312 is also supplied with a separate video signal S from the outside.

The input switching circuit 312 selects one of the separate video signal S from the outside and the video signal from the YC separation circuit 311 according to an instruction from the CPU 340 and then supplies the selected video signal to an NTSC (National Television System Committee) decoder circuit 313.

The NTSC decoder circuit 313 subjects the analog video signal inputted thereto to A/D conversion, chroma decode, and other processing, converts the analog video signal into digital component video data (video data), and then supplies the digital component video data to the video signal pre-processing circuit 314. Also, the NTSC decoder circuit 313 supplies a synchronization control circuit 328 with a clock generated on the basis of a horizontal synchronizing signal of the video signal inputted thereto, and the horizontal synchronizing signal, a vertical synchronizing signal, and a field discrimination signal obtained by sync separation.

The synchronization control circuit 328 generates a clock signal and a synchronizing signal for providing timing necessary in each circuit block, using each signal supplied to the synchronization control circuit 328 as a reference, and then supplies the clock signal and synchronizing signal to each circuit block.

The video signal pre-processing circuit 314 subjects the video data inputted thereto to various video signal processing such as prefilter processing and the like and supplies the processed video data to an MPEG video encoder 315 and the video signal post-processing circuit 324.

The MPEG video encoder 315 subjects the image data from the video signal pre-processing circuit 314 to encode processing such as block DCT (Discrete Cosine Transform) and the like, thereby generates a video ES, and then supplies the video ES to the multiplexing/separating circuit 316.

In the meantime, the A/D converter 308 converts the audio signal selected by the input switching circuit 307 into a digital audio signal (audio data) and then supplies the digital audio signal to the audio signal pre-processing circuit 309. The audio signal pre-processing circuit 309 subjects the audio data supplied thereto to filter processing and then supplies the audio data to an MPEG audio encoder 310.

The MPEG audio encoder 310 compresses the audio data supplied thereto in accordance with an MPEG format, thereafter generates an audio ES, and then supplies the audio ES to the multiplexing/separating circuit 316 as in the case of the video data.

At a time of recording, the multiplexing/separating circuit 316 multiplexes the video ES from the MPEG video encoder 315, the audio ES from the MPEG audio encoder 310, and various control signals. Specifically, the multiplexing/separating circuit 316 at the time of recording subjects the MPEG video ES and the MPEG audio ES inputted thereto to multiplexing processing together with the various control signals and thereby generates a TS signal for an MPEG system, for example. The TS signal generated in the multiplexing/separating circuit 316 is recorded on the recording medium 318 via the buffer control circuit 317.

As shown in FIG. 9, the audio data from the audio signal pre-processing circuit 309 is supplied to the MPEG audio encoder 310 and also supplied to the audio signal post-processing circuit 320. The video data from the video signal preprocessing circuit 314 is supplied to the MPEG video encoder 315 and also supplied to the video signal post-processing circuit 324.

An analog audio signal is formed and outputted by the functions of the audio signal post-processing circuit 320 and the D/A converter 321. An analog video signal is formed and outputted by the functions of the video signal post-processing circuit 324, the OSD circuit 325, and the NTSC encoder 326.

Thus, in parallel with processing for converting analog signals supplied via the terrestrial wave tuner 304, the analog audio input terminal 305, and the analog video input terminal 306 into digital signals and recording the digital signals onto the recording medium 318, the video data and audio data being recorded can be reproduced and outputted.

Of course, the signals from the terrestrial wave tuner 304, the analog audio input terminal 305, and the analog video input terminal 306, which signals are converted to digital signals, can be supplied to the TV sets in the other rooms and the like via the digital interface 303, the digital input/output terminal 302, and the router 5.

[Reproduction from the Hard Disk 318]

Description will next be made of an operation of the hard disk device 3 in the first embodiment when the hard disk device 3 reproduces a video signal and an audio signal recorded on the hard disk 318 as described above. The CPU 340 effects control to read a target TS signal to be reproduced from the recording medium 318 and supply the TS signal to the multiplexing/separating circuit 316 via the buffer control circuit 317. The multiplexing/separating circuit 316 at the time of reproduction separates a video ES and an audio ES from the TS signal read from the recording medium 318 and then supplies the separated audio ES to the MPEG audio decoder 319 and supplies the separated video ES to the MPEG video decoder 323.

Processing of circuit units from the MPEG audio decoder 319 on down and processing of circuit units from the MPEG video decoder 323 on down are as described above in the case of use of digital input. Specifically, an analog audio signal is formed from the audio ES supplied to the MPEG audio decoder 319 and then outputted, and an analog video signal is formed from the video ES supplied to the MPEG video decoder 323 and then outputted.

Thereby, an image and sound corresponding to the video data and the audio data read from the hard disk 318 can be outputted for viewing at for example the TV set 4A connected in a stage succeeding the analog audio output terminal 322 and the analog video output terminal 327.

Of course, the digital video signal and the digital audio signal read from the hard disk 318 can be supplied to the TV sets 4B to 4D in the other rooms and the like via the digital interface 303, the digital input/output terminal 302, and the router 5.

[Use of the Communication Connection Terminal and Communication Interface]

The hard disk device 3 in the first embodiment has a communication interface 329 and the communication connection terminal 330, as described above, so that for example the hard disk device 3 can be connected to a network such as the Internet or the like via a telephone line or the like to obtain various data via the network and send various data to the network.

The various data that can be sent and received includes video data and audio data, as well as various programs, text data, and the like. Video data and audio data can be recorded on the recording medium 318 via the multiplexing/separating circuit 316.

Also, video data and audio data obtained via the communication network can be reproduced and used by utilizing the multiplexing/separating circuit 316, an audio signal reproducing system including the MPEG audio decoder 319, the audio signal post-processing circuit 320, the D/A converter 321, and the audio output terminal 322, and a video signal reproducing system including the MPEG video decoder 323; the video signal post-processing circuit 324, the OSD 325, the NTSC encoder 326, and the video output terminal 327.

Further, the video data and the audio data obtained via the communication interface 329 and the communication connection terminal 330 can be supplied to the TV sets 4B to 4D in the other rooms and the like via the digital interface 303, the digital input/output terminal 302, and the router 5.

Further, a program, control data, and the like for use in the hard disk device 3 in the first embodiment can be provided via the network, recorded and retained in the EEPROM 343 or the like, and used as required.

For example, it is possible via the communication network to upgrade the functions of the hard disk device 3 in the first embodiment and obtain EPG data and the like in advance to create an electronic program guide table in advance.

It is to be noted that while in the first embodiment, video data and audio data are compressed by the MPEG system, it is possible to use another compression system and to process non-compressed video data and audio data without data compression.

When a control signal to the hard disk device 3 is received through the digital input/output terminal 302 and the digital interface 303, the control signal is supplied from the digital interface 303 to the CPU 340 and then used. Conversely, a signal such as a request from the CPU 340 of the hard disk device 3 in the first, embodiment can be transmitted to the controlling apparatus main unit 2 or the like through the digital interface 303 and the digital input/output terminal 302.

[Time Shift Viewing]

When a broadcast program provided by BS television broadcasting, CS television broadcasting, or terrestrial television broadcasting is viewed, the hard disk device 3 in the first embodiment once records a broadcast signal of the broadcast program selected for viewing onto the hard disk 318, and reads and reproduces the broadcast signal of the target broadcast program from the hard disk 318. Thus, the hard disk device 3 can reproduce television broadcast programs via the hard disk 318 at all times.

When a user goes off to a bathroom, for example, while viewing a broadcast program, the user performs a predetermined operation such as a reproduction pause, whereby the recording of the broadcast program onto the hard disk 318 is continued and the reproduction of the broadcast program is stopped until the reproduction pause is cleared. When the user returns, the user performs a predetermined operation such as clearing the reproduction pause, and can thereby continue viewing the broadcast program from a scene at the time of leaving the room.

Further, as will be described later in detail, the function of time shift viewing is extended by control of the controlling apparatus main unit 2 so that even when the user moves to another room, the viewing in the destination room of the television broadcast program viewed in the previous room from a part continuous with that viewed in the previous room is enabled automatically. That is, contents reproduced via the hard disk device 3 can follow the user.

[Example of Configuration of the TV Set 4]

Description will next be made of an example of configuration of the TV sets 4A to 4D installed in the respective rooms as shown in FIG. 1 and FIG. 2 and connected to the controlling apparatus main unit 2 and the hard disk device 3 via the router 5.

Incidentally, although there is a difference between the TV set 4A and the TV sets 4B to 4D in that the TV set 4A is a high definition-capable high-grade set whereas the TV sets 4B to 4D are ordinary sets not capable of high-definition television, the TV sets 4A to 4D have the same basic functions. Therefore, in the following, the TV sets 4A to 4D will be described as TV sets 4 having similar configurations.

Figure 10:
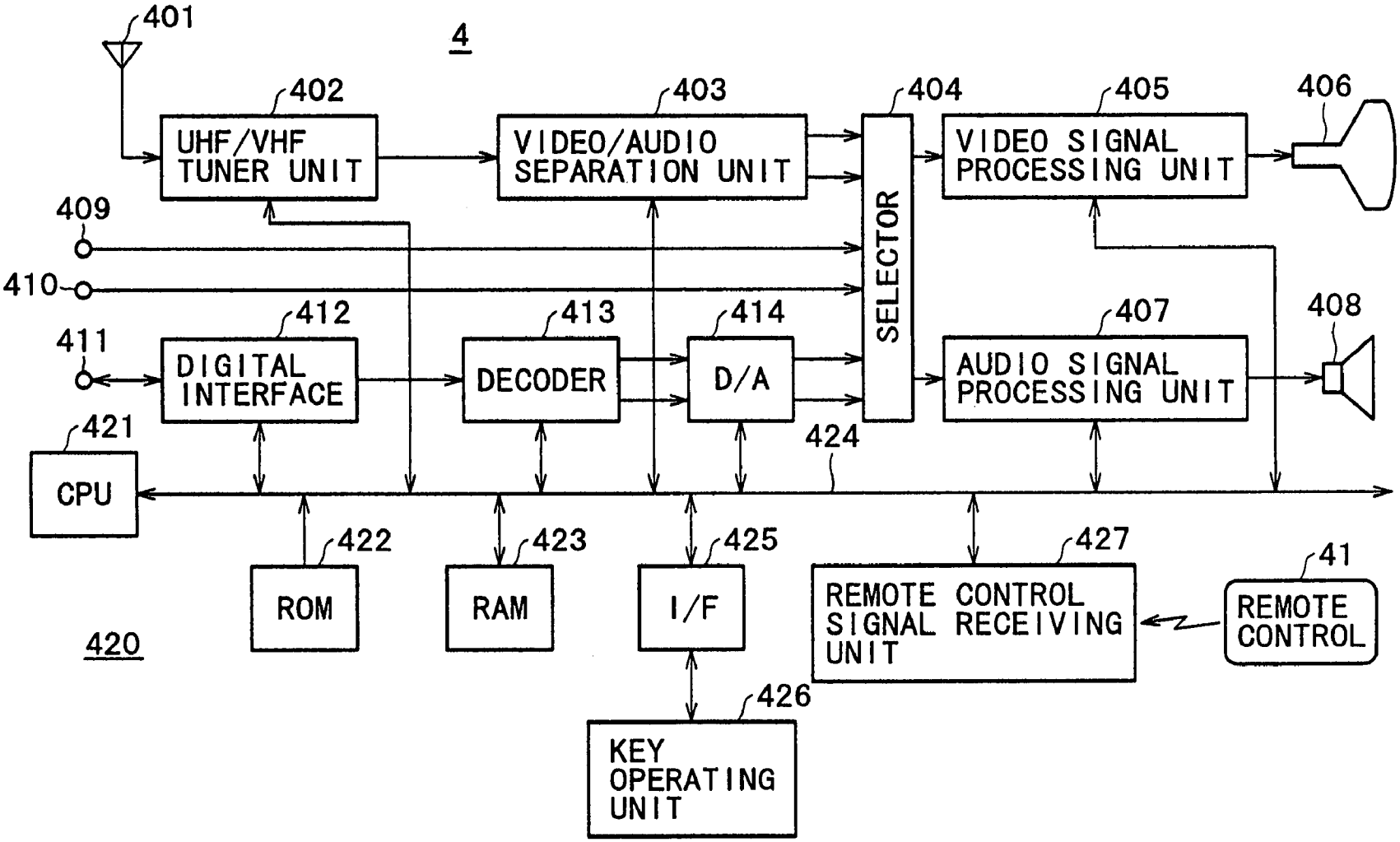
FIG. 10 is a diagram of assistance in explaining a TV set 4 used in the home network system shown in FIG. 1 and FIG. 2.

FIG. 10 is a block diagram of assistance in explaining an example of configuration of a TV set 4 in the first embodiment. As shown in FIG. 10, the TV set 4, in the first embodiment has a control unit 420 of a configuration of a microcomputer, in which a CPU 421, a ROM 422, and a RAM 423 are connected to each other via a CPU bus 424. The control unit 420 controls each part of the TV set 4.

The CPU bus 424 is connected with a key operating unit 426 via an I/F 425 and connected with a remote control signal receiving unit 427. The key operating unit 426 has various operating keys for receiving instruction input from a user, such as numeric keys, channel selection keys, sound volume adjusting keys, and the like.

The remote control signal receiving unit 427 can receive an infrared remote control signal from a remote control 41 having various operating keys as with the key operating unit 426, convert the infrared remote control signal into an electric signal, and then supply the electric signal to the control unit 420. The control unit 420 can control each part according to instruction input from a user. The input is received via the key operating unit 426 or the remote control signal receiving unit 427.

As shown in FIG. 10, the TV set 4 in the first embodiment has three input terminal parts. A video signal and an audio signal inputted via the input terminal parts are supplied to a selector 404.

Specifically, a terrestrial television broadcast signal received by a receiving antenna 401 is supplied to a UHF/VHF tuner unit 402. The UHF/VHF tuner unit 402 receives and selects a target television broadcast signal from the television broadcast signal supplied thereto on the basis of a channel selection control signal from the control unit 420, demodulates the received and selected television broadcast signal, and then supplies the demodulated television broadcast signal to a video/audio separation unit 403. The video/audio separation unit 403 separates a video signal and an audio signal from the demodulated television broadcast signal supplied thereto, and then supplies the video signal and the audio signal to the selector 404.

An analog video signal and an analog audio signal from an external device such as a VTR, a DVD player, or the like, for example, are supplied via an input terminal 409 for an analog video signal and an input terminal 410 for an analog audio signal. The analog video signal and the analog audio signal received via the analog video signal input terminal 409 and the analog audio signal input terminal 410 are also supplied to the selector 404.

Packet data (digital data) including video data and audio data transmitted via the router 5, for example, is received via a digital input/output terminal 411. The received digital data is supplied to a digital interface 412. The digital interface 412 captures the digital data transmitted to the TV set 4, converts the digital data into digital data in a form processible in the TV set 4 in the first embodiment, and then supplies the digital data to a decoder 413.

The decoder 413 decodes the digital data supplied thereto in an encoded state, thereby reconstructs digital data before encoding, and also separates the video data and the audio data. The decoder 413 supplies each of the video data and the audio data to a D/A (Digital/Analog) converter unit 414.

The D/A converter unit 414 converts the video data and the audio data of the digital signal supplied thereto into analog signals and then supplies the video signal and the audio signal after the conversion to the selector 404.

The selector 404 outputs a video signal and an audio signal from a specified input terminal on the basis of a selection control signal from the control unit 420 corresponding to an instruction input from a user. Specifically, the selector 404 performs switching to output the video signal and the audio signal from the UHF/VHF tuner unit 402, output the video signal and the audio signal supplied via the input terminals 409 and 410, or output the video signal and the audio signal supplied via the digital input/output terminal 411.

The video signal outputted from the selector 404 is supplied to a video signal processing unit 405, where the video signal is converted into a video signal in a form for supply to a display 406. The video signal after the conversion is supplied to the display 406. Thereby video corresponding to the video signal supplied to the display 406 is displayed on a screen of the display 406.

The audio signal outputted from the selector 404 is supplied to an audio signal processing unit 407, where the audio signal is converted into an audio signal for supply to speaker 408. The audio signal after the conversion is supplied to the speaker 408. Thereby audio corresponding to the audio signal supplied to the speaker 408 is emitted from the speaker 408.

When a control signal to the TV set 4 is received through the digital input/output terminal 411 and the digital interface 412, the control signal is supplied from the digital interface 412 to the control unit 420 and then used. Conversely, a signal such as a request from the control unit 420 of the TV set 4 in the first embodiment can be transmitted to the controlling apparatus main unit 2 or the like through the digital interface 412 and the digital input/output terminal 411.

[Processing at a Time of Return Home and Processing for Time Shift Viewing of a Broadcast Program]

The operation of the thus formed home network system according to the first embodiment will next be described specifically with reference to flowcharts of FIG. 11 and FIG. 12.

[Processing at a Time of Return Home]

Figure 11:
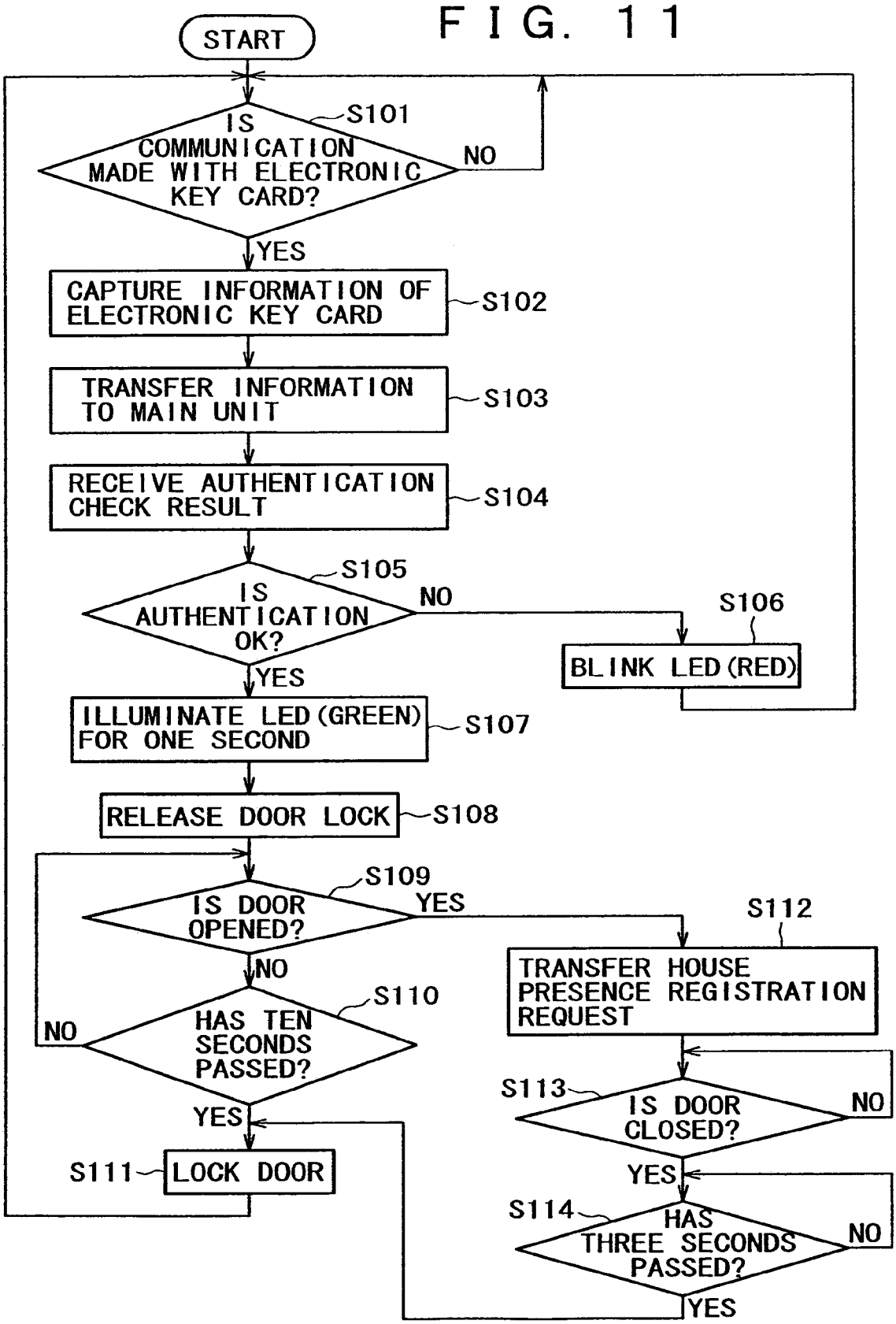
FIG. 11 is a flowchart of assistance in explaining processing in a case of authenticating a family member when the family member returns home and controlling a door lock mechanism in the home network system shown in FIG. 1 and FIG. 2.

With reference to FIG. 11, description will first be made of operation mainly in the controlling apparatus main unit 2 and the transmitting and receiving unit 21E in a case where a family member returns to the house where the thus formed home network system according to the first embodiment is constructed.

The control unit 50 of the transmitting and receiving unit 21E connected to the controlling apparatus main unit 2 monitors communication with the electronic key card 1, for example, at certain intervals at all times (step S101).

When the control unit 50 of the transmitting and receiving unit 21E determines in the processing at the step S101 that a communication is made with the electronic key card 1, the control unit 50 of the transmitting and receiving unit 21E captures information such as personal ID and the like from the electronic key card 1 held to the transmitting and receiving unit 21E via the read/write unit 62 (step S102) adds the device ID of the transmitting and receiving unit 21E to the information, and then transfers the information to the controlling apparatus main unit 2 via the I/F 59 (step S103).

The controlling apparatus main unit 2 performs an authentication check to determine whether a holder of the electronic key card 1 is a family member registered in advance in the controlling apparatus main unit 2 on the basis of the personal ID from the electronic key card 1. The personal ID is transmitted from the transmitting and receiving unit 21E at the step S103. The controlling apparatus main unit 2 returns a result of the authentication check to the transmitting and receiving unit 21E specified as destination.

The control unit 50 of the transmitting and receiving unit 21E receives the result of the authentication check returned from the controlling apparatus main unit 2 via the I/F 59, as described above (step S104) and then determines whether the received result of the authentication check indicates that the holder of the electronic key card 1 is authenticated (whether authentication is OK) (step S105).

When the control unit 50 determines in the determination processing at the step S105 that the holder of the electronic key card 1 is not authenticated, the control unit 50 blinks a red LED of the LED 61 of the transmitting and receiving unit 21E (step S106) and then repeats the processing from the step S101.

Thus, when authentication processing is not performed properly because the personal ID cannot be captured correctly from the electronic key card 1, for example, normal processing can be performed by retrying the processing from the step S101. In a case where the electronic key card 1 is not used in the home network system according to the first embodiment, for example, it is not possible to proceed to processing from a step S107 on down.

When the control unit 50 of the transmitting and receiving unit 21E determines in the determination processing at the step S105 that the holder of the electronic key card 1 is authenticated, the control unit 50 lights a green LED of the LED 61 of the transmitting and receiving unit 21E for one second (step S107) to notify the user that the user is authenticated. The control unit 50 of the transmitting and receiving unit 21E then controls the door lock mechanism driving unit 57 to release the locking of the door lock mechanism disposed at a part of the entrance door (step S108).

The control unit 50 of the transmitting and receiving unit 21E determines whether the entrance door whose door lock is released is actually opened step S109). Though not shown in FIG. 8, the control unit 50 obtains an output from a door opening/closing sensor disposed at the part of the entrance door via an I/F and determines whether the entrance door is opened.

When the control unit 50 determines in the determination processing at the step S109 that the entrance door is not opened, the control unit 50 monitors the time of the clock circuit 56 to determine whether ten seconds has passed from the release of the door lock (step S810).

When the control unit 50 determines in the determination processing at the step S110 that ten seconds has not passed from the release of the door lock, the control unit 50 repeats the processing from the step S109. When the control unit 50 determines in the determination processing at the step S110 that ten seconds has passed from the release of the door lock, the control unit 50 controls the door lock mechanism driving unit 57 to lock the door (step S111) and then repeats the processing from the step S101. When the control unit 50 of the transmitting and receiving unit 21E determines in the determination processing at the step S109 that the entrance door is actually opened, the control unit 50 generates a request for registration of the person present in the house and then transfers the request to the controlling apparatus main unit 2 via the I/F 59 (step S112).

Receiving the request for registration of the person present in the house, the controlling apparatus main unit 2 performs processing for registration of the person present in the house in which processing a house presence/house absence flag of the user personal information shown in FIG. 5, which information is formed in the EEPROM 204, is set to a state indicating presence in the house.

As in the determination processing at the step S109, the control unit 50 of the transmitting and receiving unit 21E obtains output from the door opening/closing sensor disposed at the part of the entrance door via the I/F and waits until the entrance door judged to be opened at the step S109 is closed (step S113).

When the control unit 50 determines at the step S113 that the entrance door is closed, the control unit 50 waits for three seconds (step S114). The control unit 50 thereafter proceeds to the processing at the step S111 to lock the entrance door and then repeats the processing from the step S101.

Thus, in the home network system according to the first embodiment, by only holding the electronic key card 1 possessed by each member of the family to the read/write unit 62 of the transmitting and receiving unit 21E disposed at the entrance, authentication check of the family member is performed, and only when the family member is authenticated, the door lock at the entrance is released to allow entrance into the house.

[Processing in Time Shift Viewing of a Broadcast Program]

Processing in time shift viewing of a broadcast program in the home network system according to the first embodiment will next be described with reference to FIG. 12. Prior to concrete description of the processing, an outline of time shift viewing of a broadcast program will first be described.

As described above, the home network system according to the first embodiment uses the hard disk device 3 to enable time shift viewing of a broadcast program in a different room. The time shift viewing of a broadcast program in a different room in this case can be realized by using the room presence monitoring information formed in the EEPROM 204 of the controlling apparatus main unit 2.

Specifically, as described above with reference to FIG. 11, when a family member of the house where the home network system according to the first embodiment is constructed returns home and holds the electronic key card 1 of the family member to the read/write unit 62 of the transmitting and receiving unit 21E, the family member is subjected to authentication check. When the family member is authenticated, the door lock is released to allow entrance into the house, and house presence registration is performed.

Similarly, when the family member enters each room or leaves a room that the family member entered in the house where the home network system according to the first embodiment is constructed, the family member holds the electronic key card of the family member to the read/write unit 62 of the transmitting and receiving unit 21A to 21E disposed in the vicinity of the door of each room, whereby personal ID is read and transferred to the controlling apparatus main unit 2. Thereby timing of entering or leaving a room is known, the room presence monitoring information shown in FIG. 6 is updated, and thus the persons present in each room is monitored.

In a case of viewing a television broadcast program in a room, when the holder of the electronic key card 1 holds the electronic key card 1 to the read/write unit 62 of the transmitting and receiving unit in that room, whereby leaving of the room of the holder of the electronic key card 1 is detected, and when there is no other person in the room, the recording of the broadcast signal onto the hard disk is continued for time shift reproduction of the broadcast signal, but the reproduction of the broadcast signal from the hard disk is stopped.

When it is detected that the holder of the electronic key card 1 enters another room, the reproduction of the broadcast signal is restarted at a reproduction position at the time of leaving the room to allow viewing at the TV set in the newly entered room. That is, the broadcast program can be reproduced so as to follow the user.

The processing at the time of time shift viewing in the home network system according to the first embodiment will be described in the following with reference to the flowchart of FIG. 12. Description in the following will be made of a case where viewing of a broadcast program is started in the room A, for example.

As described above, the electronic key card is held to the read/write unit 62 of the transmitting and receiving unit 21A of the room A, the personal ID is read, the device ID of the transmitting and receiving unit 21A is added to the personal ID, and then the personal ID is transferred to the controlling apparatus main unit 2 via the I/F 59, whereby the room presence monitoring information is updated. When the hard disk device 3 and the TV set 4A are thereafter turned on automatically or manually to enable time shift viewing, the controlling apparatus main unit 2 and the hard disk device 3 co-operate to start the processing illustrated in FIG. 12.

Specifically, the hard disk device 3 that is turned on starts receiving a broadcast signal corresponding to a channel selection instruction from the user (step S201), and records the received broadcast signal onto the hard disk 318 of the hard disk device 3 (step S202). The recording in this case is not intended to record the whole of the broadcast signal, but records the broadcast signal for about five to ten minutes, for example, which is a time taken by the viewer to leave and return, in a manner of a so-called ring buffer.

The hard disk device 3 reads the broadcast signal recorded on the hard disk 318 from a position such that the broadcast signal is delayed by a certain time (step S203). The hard disk device 3 performs processing such as decoding the broadcast signal and the like and then supplies the broadcast signal to the TV set 4A in the room A (step S204) to allow viewing of the broadcast program at the TV set 4A in the room A.

The reproduction is slightly delayed with respect to the recording in order to prevent a scene from being missed by the user when the user performs time shift viewing after leaving the room, for example.

The controlling apparatus main unit 2 determines whether personal ID is transmitted thereto from the transmitting and receiving unit 21A and the movement of the person present in the room A where the broadcast program is viewed in a mode capable of time shift viewing is detected, that is, the leaving of the person from the room A where the broadcast program is viewed in a mode capable of time shift viewing is detected (step S205).

Specifically, the controlling apparatus main unit 2 can determine from which room a transmitting and receiving unit has transmitted personal ID because each of the transmitting and receiving units 21A to 21D in the respective rooms adds the device ID of the transmitting and receiving unit to personal ID read from the electronic key card 1 and then transmits the personal ID.

When the controlling apparatus main unit 2 determines in the determination processing at the step S205 that the movement of the person from the room A is not detected, the controlling apparatus main unit 2 and the hard disk device 3 repeat the processing from the step S202. When the controlling apparatus main unit 2 determines in the determination processing at the step S205 that the movement of the person from the room A is detected, the controlling apparatus main unit 2 obtains a reproduction position on the hard disk at the time of detecting the movement via the router 5, and then stores the reproduction position (step S206). Also, at the step S206, the personal ID of the person leaving the room is recorded in the section of others of the room presence monitoring information, for example, and thus the person leaving the room is monitored.

The hard disk device 3 increases a storage area on the hard disk 318 for recording the broadcast signal and continues recording the broadcast signal (step S207). In this case, considering that the person may simply move from the room to another room, or may remain absent from the rooms for a relatively long time because the person is out of the house or taking a bath, the hard disk device 3 records the broadcast signal without erasing the recorded broadcast signal from the hard disk 318 for a period of about one to several hours or for a period until the broadcast program is ended.

Incidentally, at the step S207, when there is another person in the room where the leaving person is detected, the recording and the reproduction are continued, whereas when there is no other person in the room, the controlling apparatus main unit 2 controls the hard disk device 3 and the TV set 4A via the router 5 to stop the reproduction processing and automatically turn off the TV set 4A.

In the case of the recording of the broadcast signal until the broadcast program is ended, whether the broadcast is ended is determined on the basis of added information added to the broadcast signal or the user registers in advance the end time of the broadcast in the hard disk device 3 or the controlling apparatus main unit 2, whereby the recording of the broadcast signal until the broadcast program is ended can be realized.

Then, whether a destination of the user whose movement is detected at the step S205 is detected, that is, whether the user who left the room at the step S205 has entered one of the rooms including the one that the user left is determined (step S208).

Also in the determination processing at the step S208, the controlling apparatus main unit 2 can determine to which room the user who left the room at the step S205 has moved because data transmitted from each of the transmitting and receiving units 21A to 21D has the device ID of the transmitting and receiving unit added thereto.

The determination processing at the step S208 can also be performed according to whether the user registered in the section of others of the room presence monitoring information shown in FIG. 6 has entered one of the rooms. The user can register the entering of the room by holding the electronic key card of the user to the read/write unit 62 of the transmitting and receiving unit. 21A to 21D of the room the user has entered.

When it is determined in the determination processing at the step S208 that the destination is not detected, the controlling apparatus main unit 2 and the hard disk device 3 repeat the processing from the step S207. When it is determined in the determination processing at the step S208 that the destination is detected, that is, when it is determined that the user who is detected leaving the room at the step S205 is detected entering one of the rooms, the controlling apparatus main unit 2 controls the hard disk device 3 to restart reading the broadcast signal at the reproduction position, which position is stored at the step S206 on the hard disk 318, (step S209) and transfers the read broadcast signal to the TV set at the destination (step S210)

Thus, the broadcast program viewed in the room A can be automatically reproduced so as to be time-shifted and viewed even after the user moves to the room B, C, or D.

Incidentally, in the processing at the step S209, the controlling apparatus main unit 2 can check via the router 5 whether power to the TV set at the destination is turned on and automatically turn on the power to the TV set in the room when the power is not turned on. Also, when there is no person in the room from which the user moved and power to the TV set in the room remains on, the controlling apparatus main unit 2 can automatically turn off the power to the TV set in the room from which the user moved.

Figure 12:
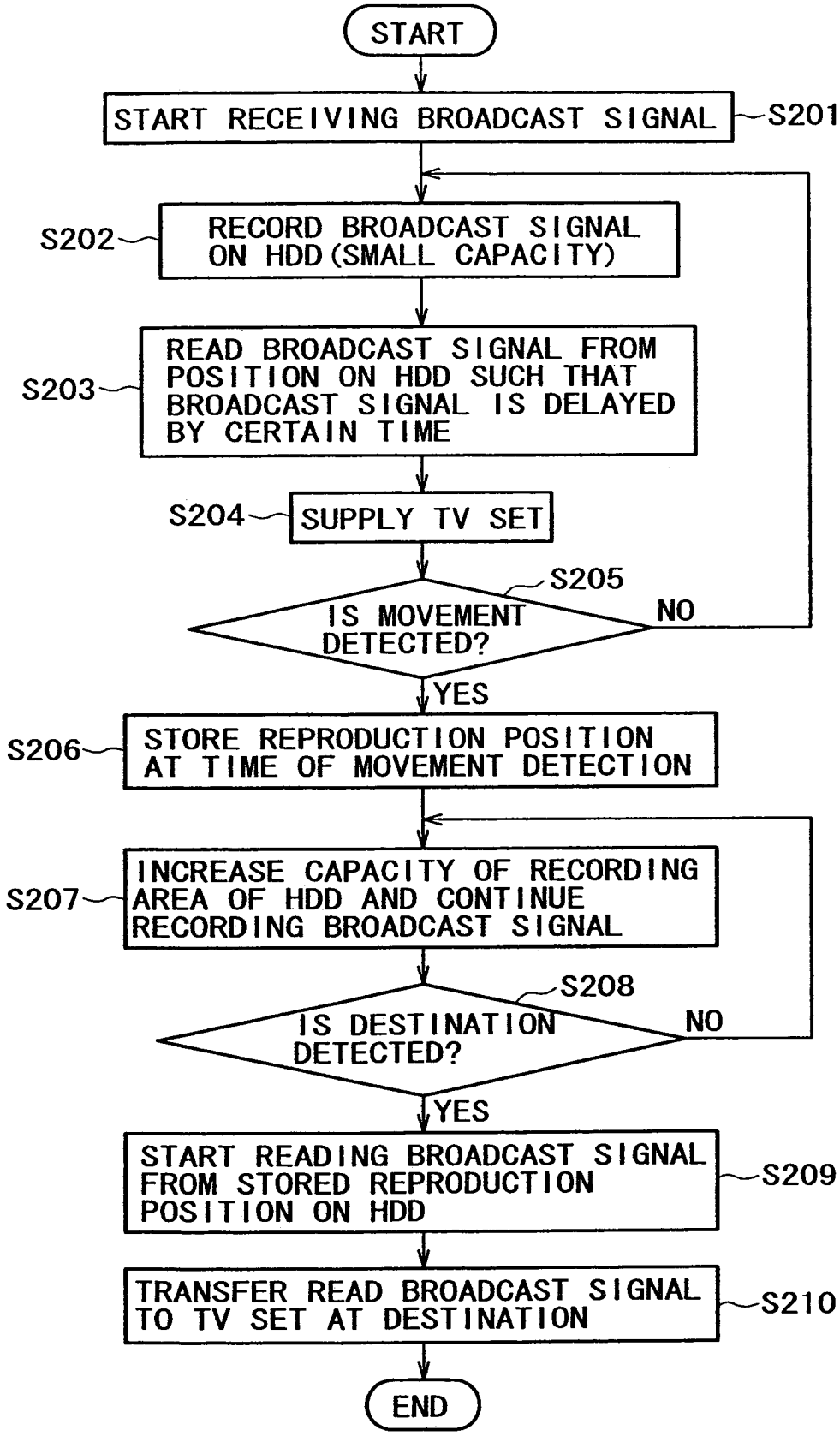
FIG. 12 is a flowchart of assistance in explaining processing in a case of so-called time shift viewing in the home network system shown in FIG. 1 and FIG. 2.

After the processing at the step S210 in FIG. 12, whether the user further moves may be determined as in the determination process at the step S205, and the processing from the step S206 may be repeated when it is determined that the user moves.

Thus, in the home network system according to the first embodiment, the entering and leaving of each room of the holder of the electronic key card 1 is monitored and further states of operation of the hard disk device 3 and the TV sets 4A to 4D are controlled, whereby both time shift viewing in the same room and time shift viewing in a different room can be realized.

Second Embodiment

Description in the foregoing first embodiment has been made of a case where so-called time shift viewing is enabled by using the hard disk device 3. However, in not only the case of time shift viewing but also a case of only reproduction of contents using a DVD player or the like, the contents can be transferred from a room as a starting point of movement of a user to a room as a destination of movement of the user so that the reproduction of the contents follows the movement of the user.

Figure 13:
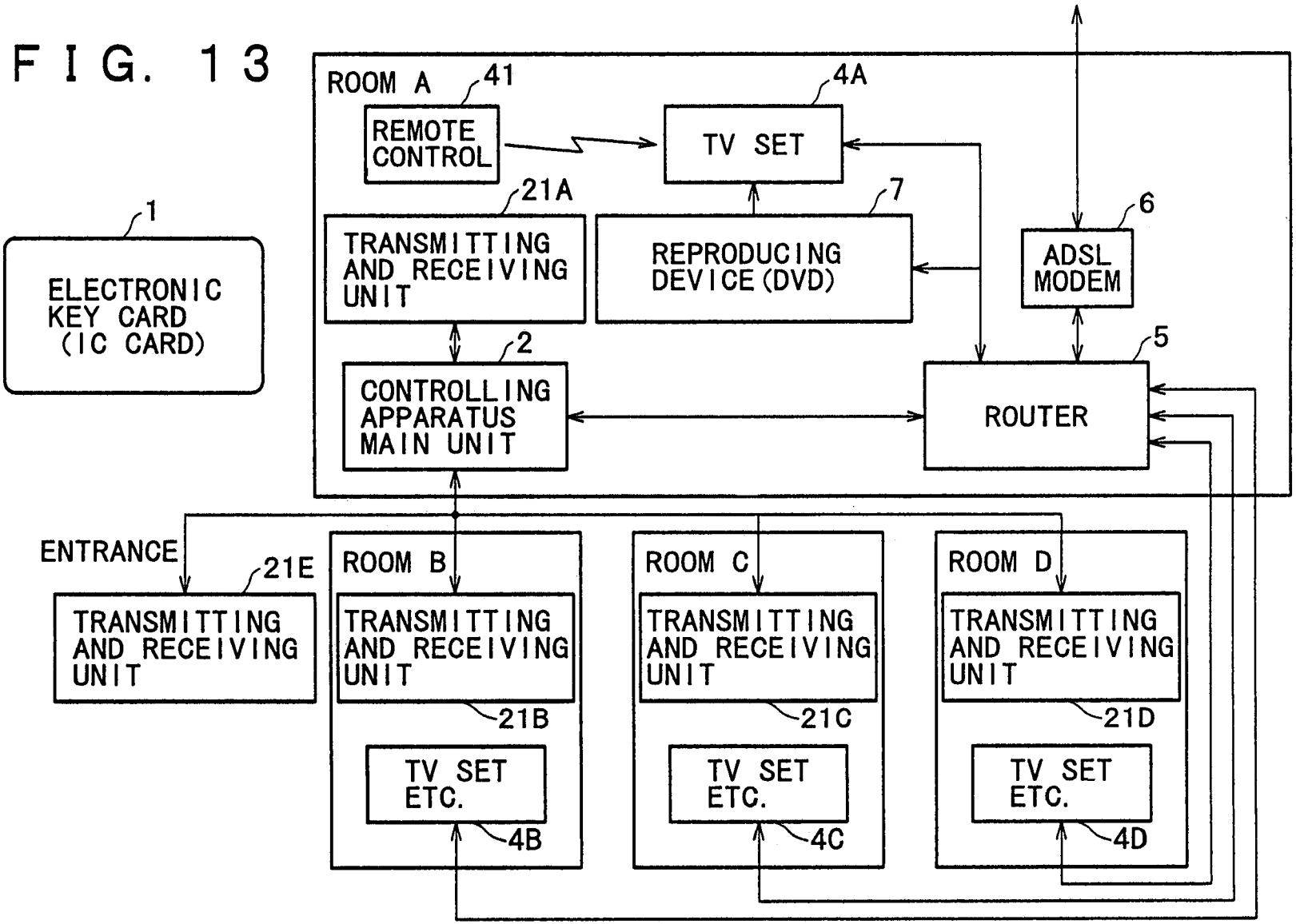
FIG. 13 is a diagram of assistance in explaining another example of a home network system to which an embodiment of an electronic device controlling apparatus and an electronic device controlling method according to the present invention is applied.

FIG. 13 is a diagram of assistance in explaining a home network system according to the second embodiment. The home network system according to the second embodiment shown in FIG. 13 is formed in a manner similar to that of the first embodiment described with reference to FIGS. 1 to 10 except that a DVD player 7 is used in place of the hard disk device 3. Therefore, in FIG. 13, parts formed in a manner similar to those of the home network system according to the first embodiment are identified by the same reference numerals, and detailed description thereof will be omitted.

As shown in FIG. 13, the DVD player 7 installed in a room A in the case of the home network system according to the second embodiment can provide a video signal and an audio signal to a TV set 4A in the room A and also provide contents data to TV sets 4B, 4C, and 4D in rooms B, C, and D via a router 5.

In the second embodiment, when a viewer views contents reproduced by the DVD player 7 on the TV set 4A in the room A, for example, and then moves to another room, the viewing of contents continued from those viewed in the room A is enabled automatically in the room to which the viewer moves, as described above. That is, the reproduced contents follow the viewer.

Figure 14:
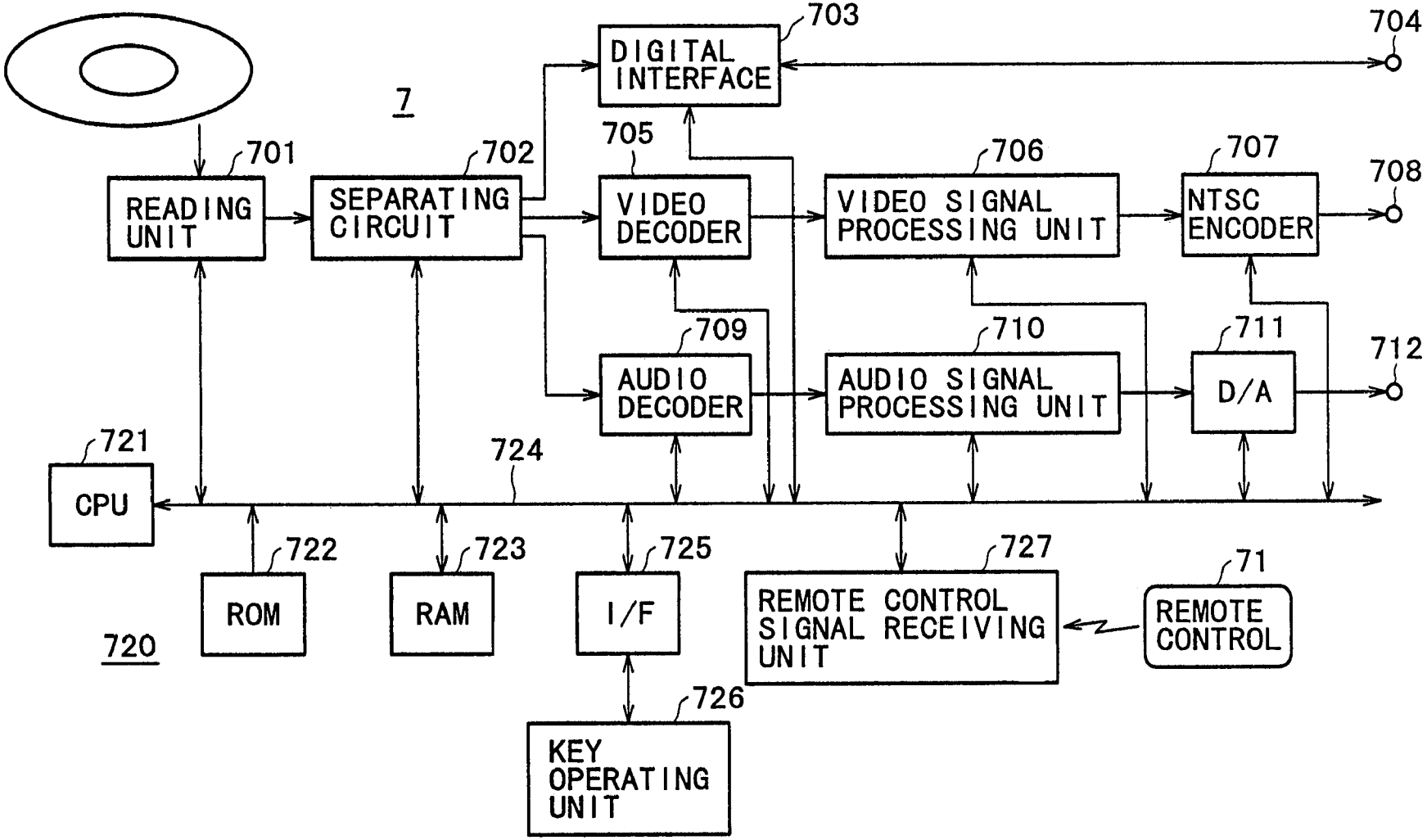
FIG. 14 is a diagram of assistance in explaining a. DVD player 7 used in the home network system shown in FIG. 13.

An example of configuration of the DVD player 7 used in the second embodiment will first be described. FIG. 14 is a block diagram of assistance in explaining an example of configuration of the DVD player 7 in the second embodiment. As shown in FIG. 14, the DVD player 7 in the second embodiment has a control unit 720 of a configuration of a microcomputer, in which a CPU 721, a ROM 722, and a RAM 723 are connected to each other via a CPU bus 724. The control unit 720 controls each part of the DVD player 7.

The CPU bus 724 is connected with a key operating unit 726 via an I/F 725 and connected with a remote control signal receiving unit 727. The key operating unit 726 has various operating keys for receiving instruction input from a user.

The remote control signal receiving unit 727 can receive an infrared remote control signal from a remote control 71 having various operating keys as with the key operating unit 726, convert the infrared remote control signal into an electric signal, and then supply the electric signal to the control unit 720. The control unit 720 can control each part according to instruction input from a user. The input is received via the key operating unit 726 or the remote control signal receiving unit 727.

Though not shown in the figure, a DVD loaded into the DVD player 7 in the second embodiment is driven for rotation by a sled motor. A reading unit 701 has an optical pickup a two-axis actuator, various servo circuits, and the like, though not shown in the figure. The reading unit 701 reads data recorded on the DVD by irradiating the DVD with laser light and receiving the reflected light and then supplies the data to a separating circuit 702.

The separating circuit 702 supplies the data from the reading unit 701 to a digital interface 703 as it is. The separating circuit 702 also separates and extracts video data and audio data from the data from the reading unit 701. Then, the circuit 702 supplies the video data to a video decoder 705 and supplies the audio data to an audio decoder 709.

The digital interface 703 converts the digital data supplied thereto into data in a form for output to the outside. Then, the interface 703 outputs the data to the outside via a digital input/output terminal 704.

The video decoder 705 decodes the video data supplied thereto in an encoded state and supplies the video data after the decoding to a video signal processing unit 706. The video signal processing unit 706 subjects the video data supplied thereto to predetermined filter processing and the like and then supplies the video data after the processing to an NTSC encoder 707.

The NTSC encoder. 707 converts the video data (component digital signals) inputted thereto into a YC signal, thereafter performs D/A conversion, generates an analog composite video signal C and an analog separate video signal S, and then outputs the signals via respective analog video signal output terminals 708 provided separately from each other.

In the meantime, the audio decoder 709 decodes the audio data supplied thereto in an encoded state and then supplies the audio data after the decoding to an audio signal processing unit 710. The audio signal processing unit 710 subjects the audio data supplied thereto to necessary processing such as filter processing, fade processing, and the like and then supplies the audio data after the processing to a D/A conversion unit 711. The D/A conversion unit 711 converts the audio data supplied thereto into an analog audio signal and then outputs the analog audio signal via an analog audio signal output terminal 712.

Thus, the DVD player 7 in the second embodiment can supply contents recorded as digital data on the DVD serving as a recording medium to the TV sets 4B to 4D disposed in the respective rooms or the like via the digital interface 703 and the router 5 disposed on the outside or the like. The DVD player 7 can also decode video data and audio data recorded on the DVD, convert the video data and the audio data into analog signals, and output the analog signals directly to the TV set 4A.

A control signal or the like is also transmitted to the DVD player 7 in the second embodiment via the router 5. The control signal or the like is received via the digital input/output terminal 704 and the digital interface 703. The control signal is supplied from the digital interface 703 to the control unit 720 to be used by the control unit 720.

Also, control data from the control unit 720 can be transmitted to another electronic device such for example as a controlling apparatus main unit 2 via the digital interface 703 and the digital input/output terminal 704.

[Processing for Reproduction of Contents from DVD]

Description will next be made of processing at a time of reproduction of contents from a DVD using the DVD player 7 in a case where: (1) contents reproduction is paused at a time of detection of movement (mode corresponding to reproduction pause); (2) contents reproduction is not stopped and a reproduction position is stored at a time of detection of movement, and reproduction is repeated after fast rewinding at a time of detection of a destination (mode corresponding to fast rewinding); and (3) contents reproduction is not stopped and a reproduction position is stored at a time of detection of movement, and processing is changed according to a destination (mode corresponding to destination).

Prior to concrete description of the processing, an outline of direct reproduction from the DVD player in a different room will first be described. As described above, the home network system according to the second embodiment uses the DVD player 7 to enable continued viewing of reproduced contents in a different room. As in the case of the time shift viewing described above, the continued viewing of contents in a different room in this case is realized by using the room presence monitoring information formed in the EEPROM 204 of the controlling apparatus main unit 2.

As in the case of the home network system according to the first embodiment, when a family member enters each room or leaves a room that the family member entered in the house where the home network system according to the second embodiment is constructed, the family member holds the electronic key card 1 of the family member to the read/write unit 62 of a transmitting and receiving unit 21A to 21D disposed in the vicinity of the door of each room, whereby personal ID is read and transferred to the controlling apparatus main unit 2 together with the device ID of the transmitting and receiving unit 21A to 21D that read the personal ID. Thereby timing of entering or leaving a room is known, the room presence monitoring information shown in FIG. 6 is updated, and thus the persons present in each room is monitored.

In a case where contents reproduced by the DVD player 7 are viewed in a room, when the holder of the electronic key card 1 holds the electronic key card 1 to the read/write unit 62 of the transmitting and receiving unit in that room and thereby leaving of the room of the holder of the electronic key card 1 is detected, the movement of the holder of the electronic key card 1 is dealt with in each of the (1) to (3) corresponding modes. In each of the cases, the reproduced contents follow the holder of the electronic key card.

The processing in each of the (1) to (3) modes mentioned above will be described in the following. In each of the cases, description will be made by taking as an example a case where the home network system formed as shown in FIG. 2 uses the DVD player 7 in place of the hard disk device 3, and viewing of contents reproduced from the DVD player is started in the room A.

[Processing in (1) Mode Corresponding to Reproduction Pause]

Processing in the (1) mode corresponding to reproduction pause will first be described with reference to a flowchart of FIG. 15. As described above., the electronic key card 1 is held to the read/write unit 62 of the transmitting and receiving unit 21A of the room that the user has entered, the personal ID is read, and then the personal ID is transferred to the controlling apparatus main unit 2 via an I/F 59 together with the device ID of the transmitting and receiving unit 21A, whereby the room presence monitoring information is updated. When the DVD player 7 and the TV set 4A are thereafter turned on automatically or manually to enable use of contents, the controlling apparatus main unit 2 and the DVD player 7 co-operate to start the processing illustrated in FIG. 15.

Specifically, the DVD player 7 that is turned on controls the reading unit 701 to read data from a DVD loaded in the DVD player 7 in response to a selection instruction from the user (step S301). The DVD player 7 converts the read data into analog signals using each circuit in the analog signal system described above. The player 7 then supplies the analog signals to the TV set 4A in the vicinity of the DVD player 7. Therefore, the player 7 allows the contents of the DVD to be viewed at the TV set 4A (step S302).

The controlling apparatus main unit 2 determines whether the personal ID is transmitted thereto from the transmitting and receiving unit 21A in the room A together with the device ID of the transmitting and receiving unit 21A, and the movement of the person present in the room A where the contents of the DVD are viewed is detected, that is, the leaving of the person from the room A is detected (step S303).

When the controlling apparatus main unit 2 determines in the determination processing at the step S303 that the movement of the person from the room A is not detected, the controlling apparatus main unit 2 and the DVD player 7 repeat the processing from the step S301.

When the controlling apparatus main unit 2 determines in the determination processing at the step S303 that the movement of the person from the room A is detected, the controlling apparatus main unit 2 controls the DVD player 7 via the router 5 to pause the reproduction of the DVD (step S304). At the step S304, the personal ID of the person leaving the room is recorded in the section of others of the room presence monitoring information, for example, and thus the person leaving the room is monitored.

Thereafter, whether a destination of the user whose movement is detected at the step S303 is detected, that is, whether the user who left the room at the step S303 has entered one of the rooms including the one that the user left is determined (step S305).

The determination processing at the step S305 is performed according to whether the user registered in the section of others of the room presence monitoring information shown in FIG. 6 has entered one of the rooms. The electronic key card 1 of the user is held to the read/write unit 62 of the transmitting and receiving unit 21A to 21D of the room the user has entered, thereby the personal ID is read from the electronic key card 1, and then the read personal ID and the device ID of the transmitting and receiving unit that read the personal ID are transmitted to the controlling apparatus main unit 2, whereby the entering of the room can be registered in the controlling apparatus main unit 2 that has received the personal ID and the device ID.

When it is determined in the determination processing at the step S305 that the destination is not detected, the processing at the step S305 is repeated to detect the destination of the target user.

When it is determined in the determination processing at the step S305 that the destination is detected, that is, when it is determined that the user who is detected leaving the room at the step S303 is detected entering one of the rooms, the controlling apparatus main unit 2 controls the DVD player 7 to restart reading contents data from the DVD (step S306), and transfers the read contents data to the TV set at the destination (step S307).

Thus, viewing of the DVD contents viewed in the room A after moving to the room B, C, or D is enabled by automatically resuming the reproduction.

Incidentally, in the processing at the step S306, the controlling apparatus main unit 2 may for example check via the router 5 whether power to the TV set at the destination is turned on, and turn on the power to the TV set in the room when the power is not turned on. Also, when there is no person in the room from which the user moved and power to the TV set in the room is turned on, the controlling apparatus main unit 2 can turn off the power to the TV set in the room.

Figure 15:
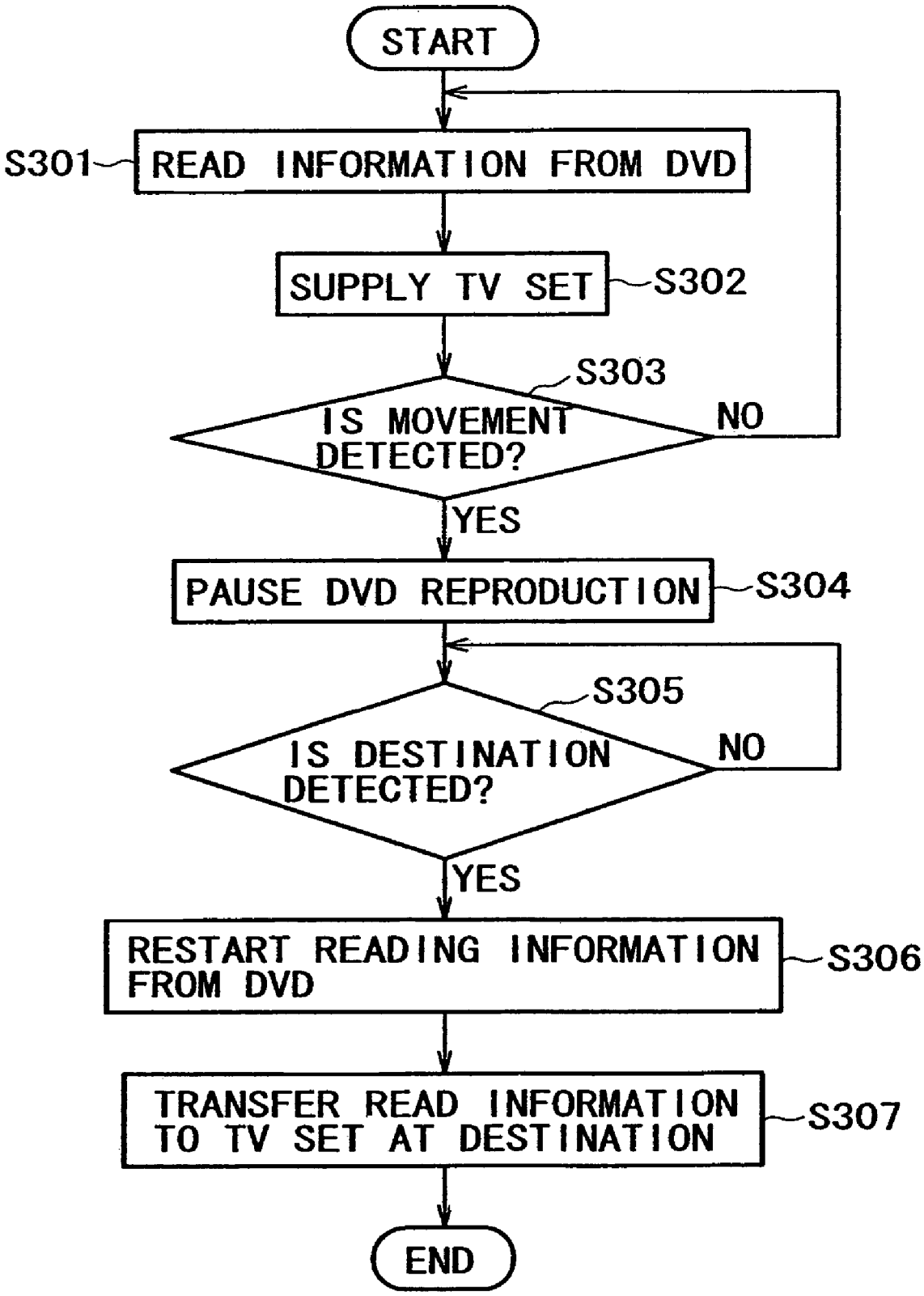
FIG. 15 is a flowchart of assistance in explaining processing in a case of transfer of reproduced data in the home network system shown in FIG. 13.

Of course, after the processing at the step S307 in FIG. 15, the main unit 2 may determine whether the user further moves as in the determination process at the step S303, and the processing from the step S304 may be repeated when the main unit 2 determines that the user moves.

[Processing in (2) Mode Corresponding to Fast Rewinding]

Processing in the (2) mode corresponding to fast rewinding will next be described with reference to a flowchart of FIG.

16. As described above, the electronic key card 1 is held to the read/write unit 62 of the transmitting and receiving unit 21A of the room that the user has entered, the personal ID is read, and then the personal ID is transferred to the controlling apparatus main unit 2 via the I/F 59 together with the device ID of the transmitting and receiving unit 21A, whereby the room presence monitoring information is updated. When the DVD player 7 and the TV set 4A are thereafter turned on automatically or manually to enable use of contents, the controlling apparatus main unit 2 and the DVD player 7 cooperate to start the processing illustrated in FIG. 16.

Specifically, the DVD player 7 that is turned on controls the reading unit 701 to read data from a DVD loaded in the DVD player 7 in response to a selection instruction from the user (step S401). The DVD player 7 converts the read data into analog signals using each circuit in the analog signal system described above. Then, the player 7 supplies the analog signals to the TV set 4A in the vicinity of the DVD player 7 and allows the contents of the DVD to be viewed at the TV set 4A (step S402).

The controlling apparatus main unit 2 determines whether the personal ID is transmitted thereto from the transmitting and receiving unit 21A in the room A together with the device ID of the transmitting and receiving unit 21A and the movement of the person present in the room A where the contents of the DVD are viewed is detected, that is, the leaving of the person from the room A is detected (step S403).

When the controlling apparatus main unit 2 determines in the determination processing at the step S403 that the movement of the person from the room A is not detected, the controlling apparatus main unit 2 and the DVD player 7 repeat the processing from the step S401.

When the controlling apparatus main unit 2 determines in the determination processing at the step S403 that the movement of the person from the room A is detected, the controlling apparatus main unit 2 controls the DVD player 7 via the router 5 to obtain a reproduction position on the DVD and store the reproduction position (step S404). In this case, the reproduction of the DVD player 7 is continued without being stopped. At the step S404, the personal ID of the person leaving the room is recorded in the section of others of the room presence monitoring information, for example, and thus the person leaving the room is monitored.

Thereafter, whether a destination of the user whose movement is detected at the step S403 is detected, that is, whether the user who left the room at the step S403 has entered one of the rooms including the one that the user left is determined (step S405).

The determination processing at the step S405 is performed according to whether the user registered in the section of others of the room presence monitoring information shown in FIG. 6 has entered one of the rooms. The electronic key card 1 of the user is held to the read/write unit 62 of the transmitting and receiving unit 21A to 21D of the room the user has entered, thereby the personal ID is read from the electronic key card 1, and then the read personal ID and the device ID of the transmitting and receiving unit that read the personal ID are transmitted to the controlling apparatus main unit 2, whereby the entering of the room can be registered in the controlling apparatus main unit 2 that has received the personal ID and the device ID.

When it is determined in the determination processing at the step S405 that the destination is not detected, the processing at the step S405 is repeated to detect the destination of the target user.

When it is determined in the determination processing at the step S405 that the destination is detected, that is, when it is determined that the user who is detected leaving the room at the step S403 is detected entering one of the rooms, the controlling apparatus main unit 2 controls the DVD player 7 to fast rewind the reproduction position on the DVD to the reproduction position stored at the step S404 (step S406), restart reading contents data from the reproduction position on the DVD which position is stored at the step S404 (step S407), and transfer the read contents data to the TV set at the destination (step S408).

Thus, viewing of the DVD contents viewed in the room A after moving to the room B, C, or D is enabled by automatically resuming the reproduction.

Incidentally, in the processing at the step S406, the controlling apparatus main unit 2 may for example check via the router 5 whether power to the TV set at the destination is turned on, and turn on the power to the TV set in the room when the power is not turned on. Also, when there is no person in the room from which the user moved and power to the TV set in the room is turned on, the controlling apparatus main unit 2 can turn off the power to the TV set in the room.

Figure 16:
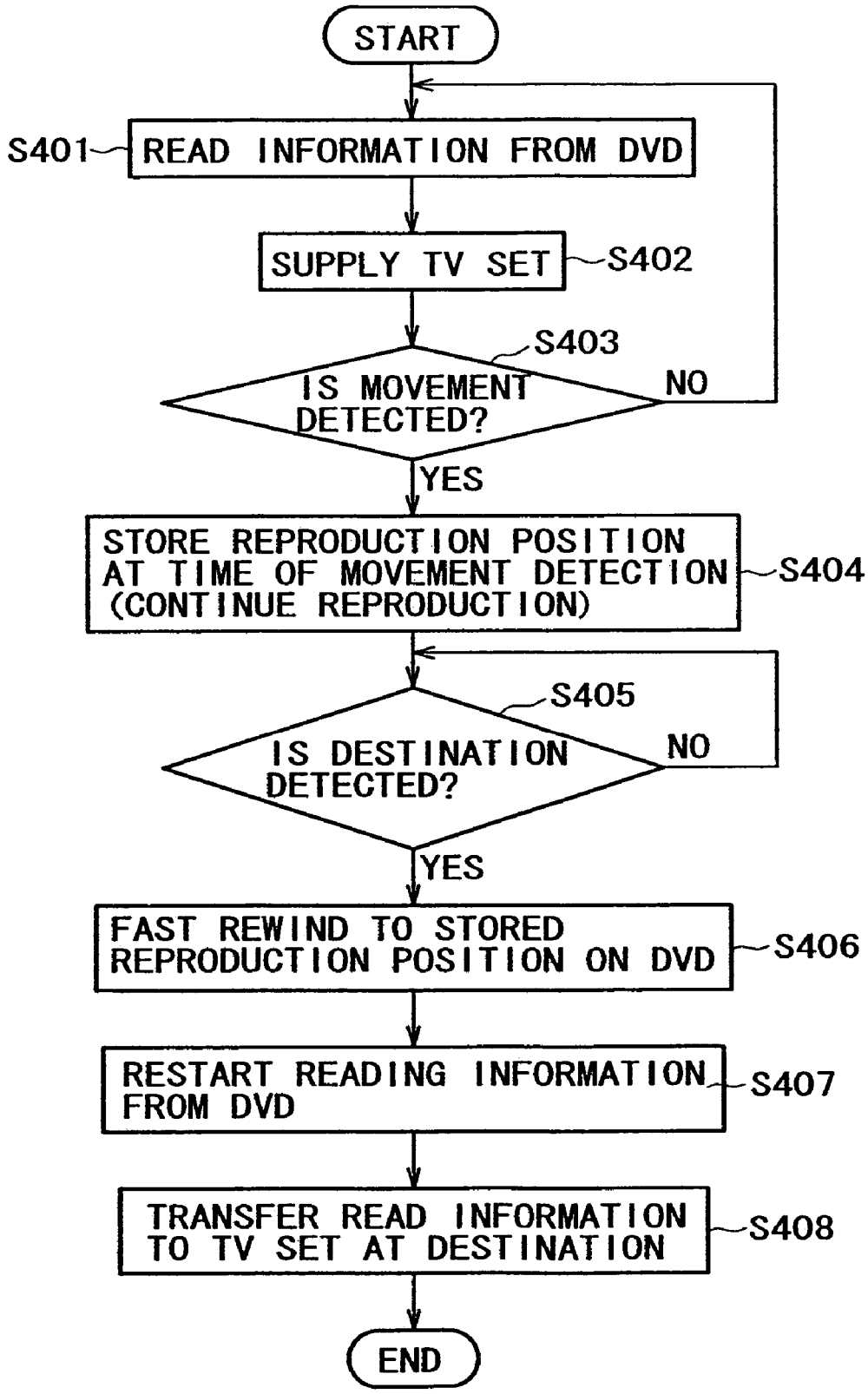
FIG. 16 is a flowchart of assistance in explaining another example of processing in the case of transfer of reproduced data in the home network system shown in FIG. 13.

Of course, after the processing at the step S408 in FIG. 16, the main unit 2 may determine whether the user further moves as in the determination process at the step S403, and the processing from the step S404 may be repeated when the main unit 2 determines that the user moves.

[Processing in (3) Mode Corresponding to Destination]

Processing in the (3) mode corresponding to destination will next be described with reference to a flowchart of FIG. 17. Processing from a step S501 to a step S505 in FIG. 17 is the same as corresponding processing from the step S401 to the step S405 shown in FIG. 16.

Figure 17:
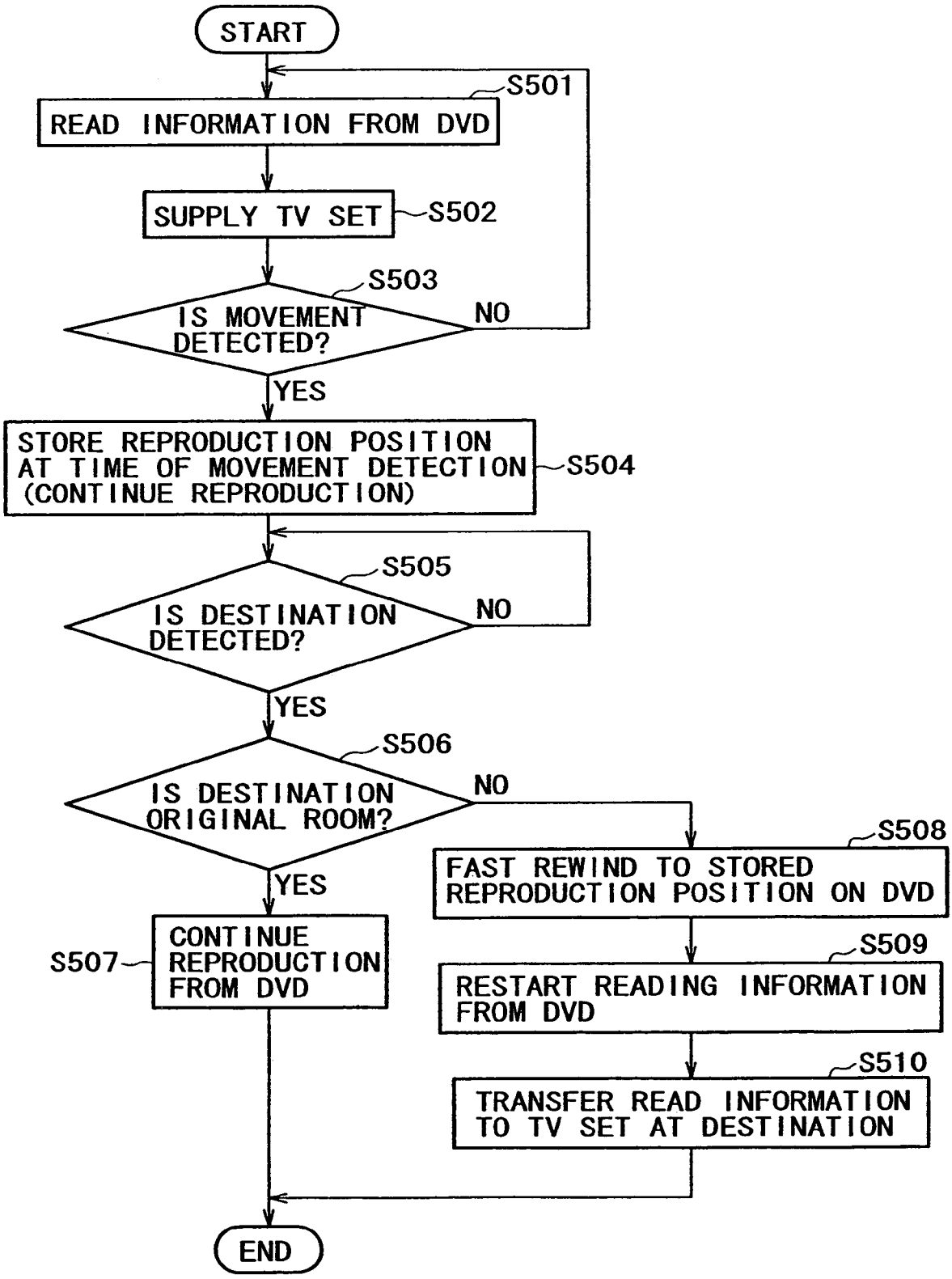
FIG. 17 is a flowchart of assistance in explaining another example of processing in the case of transfer of reproduced data in the home network system shown in FIG. 13.

In the processing in the (3) mode corresponding to destination represented in FIG. 17, when it is determined in determination processing at the step S505 that a destination of the user whose movement is detected at the step S503 is detected, whether the destination is the original room is determined (step S506).

When it is determined in the determination processing at the step S506 that the destination is the original room, the controlling apparatus main unit 2 and the DVD player 7 continue reproduction from the DVD without starting a new operation (step S507).

In this case, the user cannot view contents reproduced from the DVD during a period from the detection of the movement at the step S503 to the determination at the step S506 that the user has returned to the original room. However, when the period is very short, the user can continue viewing the contents of the DVD without using a time for fast rewinding and the like.

When it is determined in the determination processing at the step S506 that the destination is not the original room, the controlling apparatus main unit 2 controls the DVD player 7 to fast rewind the reproduction position on the DVD to a reproduction position stored at the step S504 step S508), restart reading contents data from the reproduction position on the DVD which position is stored at the step S504 (step S509), and transfer the read contents data to the TV set at the destination (step S510)

Thus, viewing of the DVD contents viewed in the room A after moving to the room B, C, or D is enabled by automatically resuming the reproduction without producing a section that cannot be viewed.

Incidentally, in the processing at the step S508, the controlling apparatus main unit 2 may for example check via the router 5 whether power to the TV set at the destination is turned on, and turn on the power to the TV set in the room when the power is not turned on. Also, when there is no person in the room from which the user moved and power to the TV set in the room is turned on, the controlling apparatus main unit 2 can turn off the power to the TV set in the room.

Of course, after the processing at the step S507 or the step S510 in FIG. 17, the main unit 2 may determine whether the user further moves as in the determination process at the step S503, and the processing from the step S504 may be repeated when the main unit 2 determines that the user moves.

Thus, in the home network system according to the second embodiment, the entering and leaving of each room of the holder of the electronic key card 1 is monitored and further states of operation of the DVD player 7 and the TV sets 4A to 4D are controlled, whereby the reproduced contents can follow the movement of the user automatically.

In this case, only by a very simple operation of holding the electronic key card 1 to the read/write unit 62 of the transmitting and receiving unit in each room without performing a complicated operation of the DVD player 7 or the TV sets 4A to 4D, the user can change the TV set as destination of contents data from the DVD player 7 so as to follow the movement of the user and view a continuation of the DVD contents without missing the video and audio thereof, as described above.

It is to be noted that while the case of time shift viewing using the hard disk device 3 has been described as an example in the first embodiment and the case of transfer of data to a destination using the DVD player has been described as an example in the second embodiment, it is possible to support both the cases according to the device reproducing the contents when both the hard disk device 3 and the DVD player 7 are provided.

Also, the reproducing device is not limited to the. DVD player. The transfer of data according to movement of the user, which has been described as the case of using the DVD player, can be performed when reproducing devices or recording and reproducing devices using various recording media such as VTRs (Video Tape Recorders), laser disk players, and the like are used.

In the above case, even when the DVD player 7 reproduces contents from a DVD, at least the (1) (2), and (3) modes described above can be each used properly according to preference of the user or the like.

Third Embodiment

In the first and second embodiments described above, necessary information such as personal ID is read from the electronic key card held to the transmitting and receiving units 21A to 21D via the transmitting and receiving units 21A to 21D installed in the respective rooms and connected to the controlling apparatus main unit 2, and the information is supplied to the controlling apparatus main unit 2, whereby detection and registration of entering and leaving of each room of the user are performed. It is possible, however, to construct a home network system without providing the transmitting and receiving unit in each room.

The third embodiment to be described in the following performs the detection and registration of entering and leaving of each room on the basis of a remote control signal from a remote commander (hereinafter referred to as a remote control) as a device for remote control of an electronic device such as a TV set 4A to 4D provided in each room or the like. The third embodiment realizes time shift viewing using a hard disk device and transfer of data reproduced from a reproducing device such as a DVD player or the like to a destination.

Figure 18:
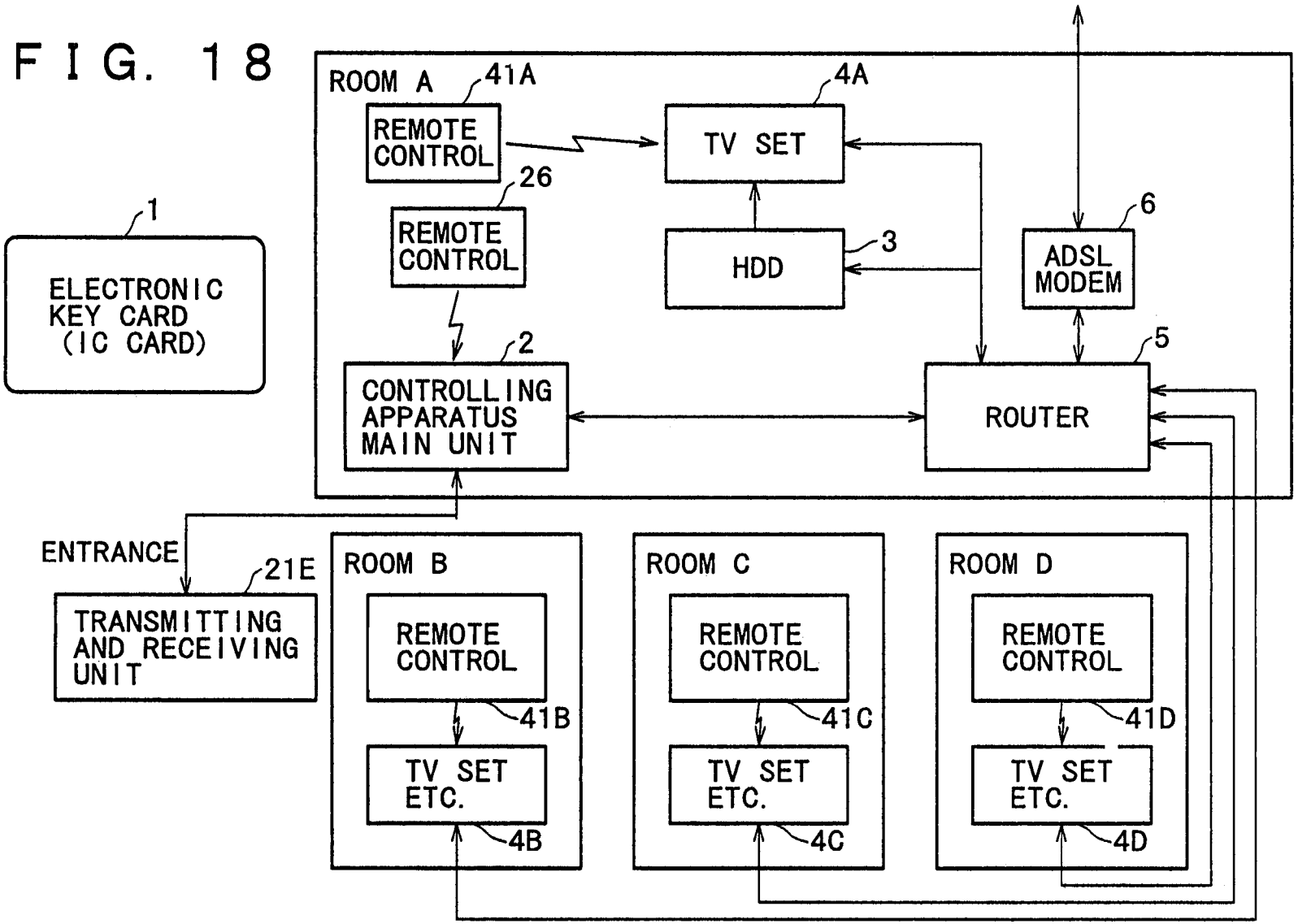
FIG. 18 is a diagram of assistance in explaining another example of a home network system to which an embodiment of an electronic device controlling apparatus and an electronic device controlling method according to the present invention is applied.

FIG. 18 is a diagram of assistance in explaining an example of configuration of a home network system according to the third embodiment. In the home network system according to the third embodiment shown in FIG. 18, parts formed in a manner similar to those of the home network system according to the first embodiment described with reference to FIGS. 1 to 12 are identified by the same reference numerals, and detailed description thereof will be omitted.

As shown in FIG. 18, a room A in the home network system according to the third embodiment includes a controlling apparatus main unit 2, a hard disk device 3, a TV set 4A, a router 5, and an ADSL modem 6. Other rooms B, C, and D include TV sets 4B, 4C, and 4D, respectively. A remote commander (hereinafter referred to as remote control) 26 is a device for remote control of the controlling apparatus main unit 2.

The controlling apparatus main unit 2, the hard disk device 3, the TV set 4A, and the ADSL modem 6 provided in the room A and the TV sets 4B, 4C, and 4D provided in the other rooms B, C, and D are connected to one another via the router 5 to send and receive control data and contents data such as video data and audio data and the like.

As shown in FIG. 18, however, although the home network system according to the third embodiment has a transmitting and receiving unit 21E on the outside of an entrance part, which unit is connected to the controlling apparatus main unit 2, the home network system has no transmitting and receiving unit connected to the controlling apparatus main unit 2 in any room.

That is, the home network system according to the third embodiment is similar to the home network systems according to the first and second embodiments described above in that each family member is subjected to authentication check using an electronic key card 1 given to each family member at a time of return home and when the family member is authenticated, a door lock is released to allow entrance into the house. The registration of entering and leaving of each room, however, is for example performed via remote commanders 41A, 41B, 41C, and 41D (hereinafter referred to as remote controls) as devices for remote control of the TV sets 4A, 4B, 4C, and 4D installed in the respective rooms.

[Example of Configuration of a Remote Control 41]

Figure 19:
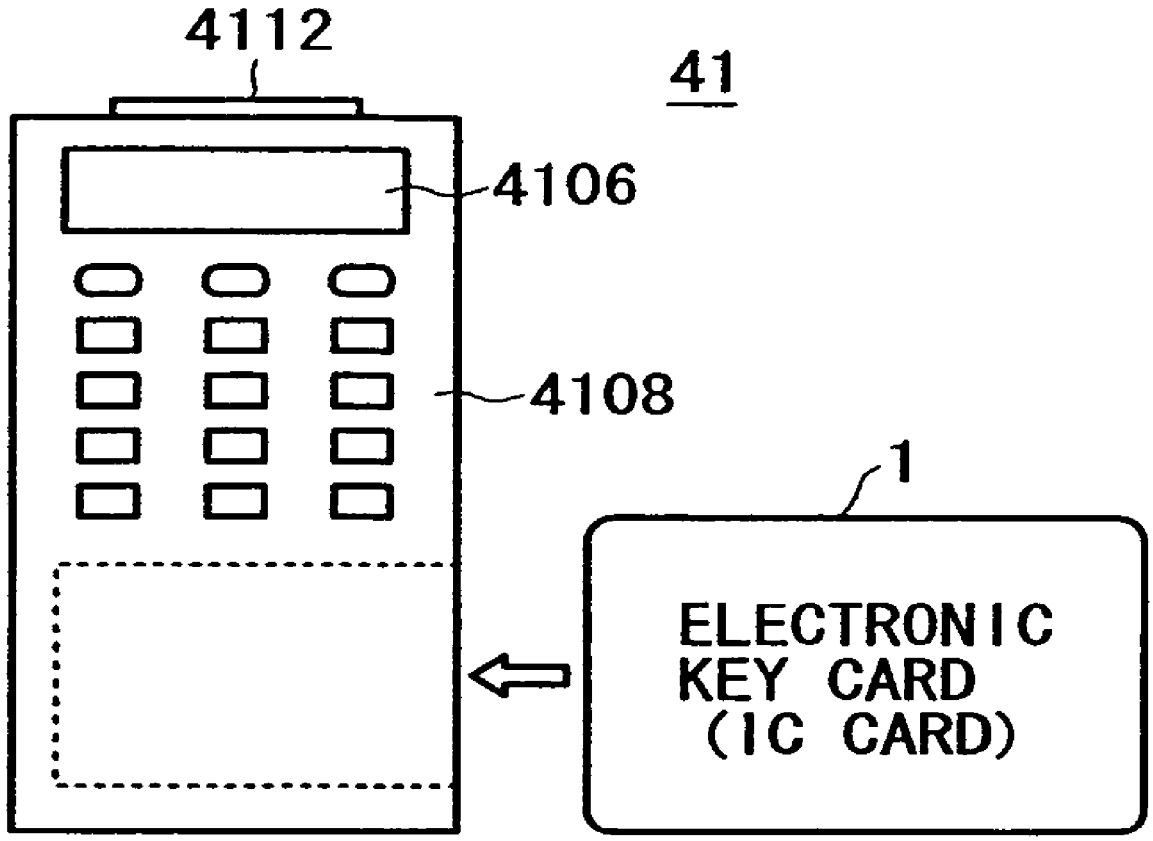
FIG. 19 is a diagram of assistance in explaining an external appearance of a remote control 41 of a TV set 4 used in the home network system shown in FIG. 18.
Figure 20:
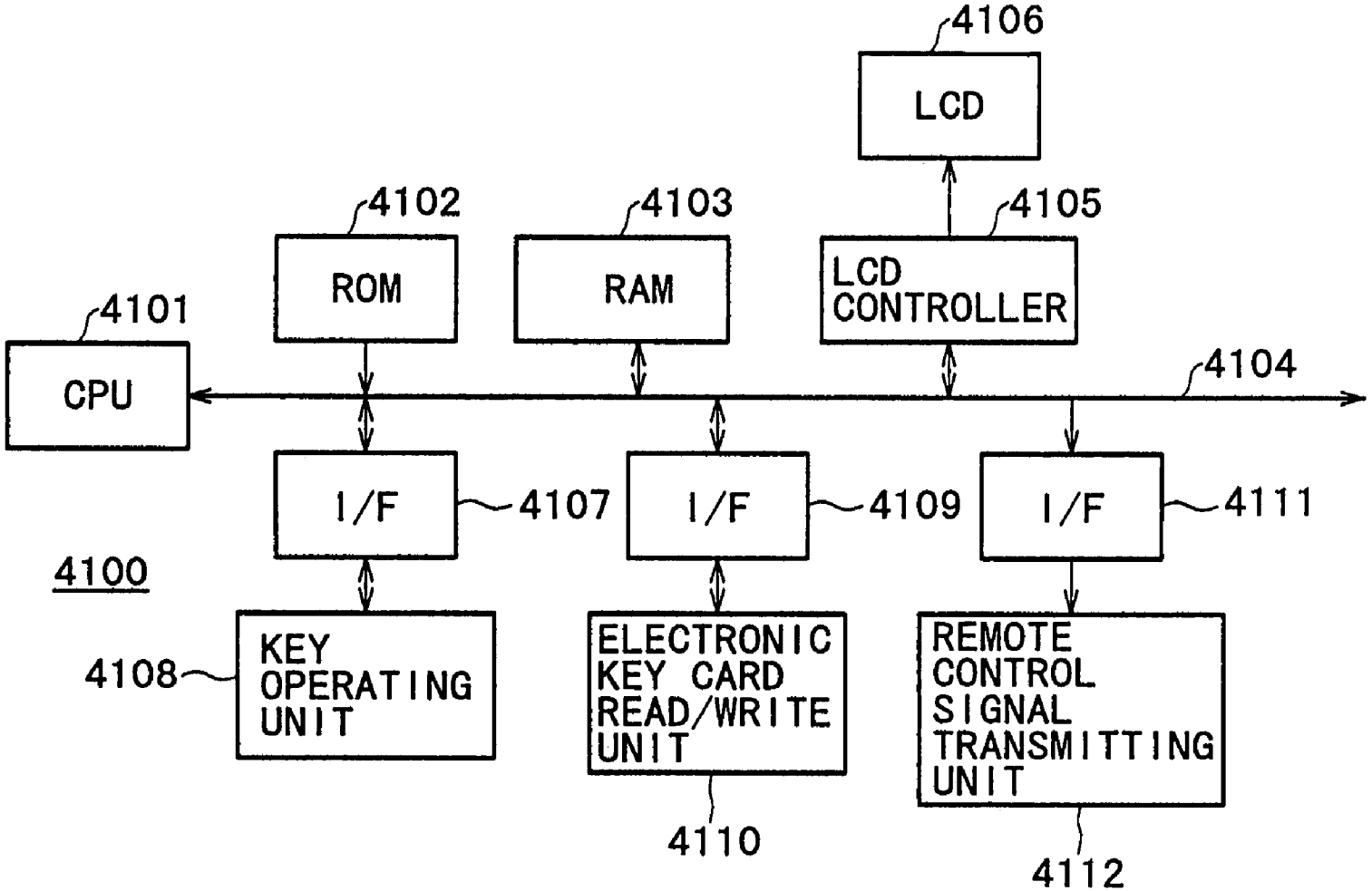
FIG. 20 is a diagram of assistance in explaining a configuration of the remote control 41 of the TV set 4 used in the home network system shown in FIG. 18.

FIG. 19 and FIG. 20 are diagrams of assistance in explaining the remote controls 41A, 41B, 41C, and 41D of the TV sets 4A, 4B, 4C, and 4D installed in the respective rooms in the third embodiment. The remote controls 41A, 41B, 41C, and 41D are formed in a substantially similar manner, and therefore the remote controls 41A, 41B, 41C, and 41D will each be described in the following as a remote control 41.

FIG. 19 is a diagram of assistance in explaining an external appearance of the remote control 41 of the TV set 4 installed in each room in the third embodiment. As shown in FIG. 19, the remote control 41 of the TV set 4 in the third embodiment is provided on a front panel surface with an LCD 4106 for displaying various information and an operating key group 4108 including a plurality of operating keys for receiving instruction input from a user such as numeric keys, function keys, and the like.

In the third embodiment, a slot for an electronic key card is disposed so as to have an opening at a right side of the remote control 41, as shown in FIG. 19. The slot loads the electronic card of each person. A read/write unit 4110 for an electronic key card is disposed inside the slot so as to be opposed to the electronic key card 1 loaded in the slot to read data from the electronic key card loaded in the slot and write data to the electronic key card.

FIG. 20 is a block diagram of assistance in explaining a configuration of the remote control 41. As shown in FIG. 20, the remote control 41 has a control unit 4100 of a configuration of a microcomputer, in which a CPU 4101, a ROM 4102, and a RAM 4103 are connected to each other via a CPU bus 4104.

The CPU bus 4104 is further connected with an LCD controller 4105 and I/Fs 4107, 4109, and 4111. The LCD controller 4105 is connected with an LCD 4106. Under control of the LCD controller 4105, which is controlled by the control unit 4100, the LCD 4106 can display information such as a state of operation, various guidance, and the like.

The I/F 4107 is connected with a key operating unit 4108; the I/F 4109 is connected with the electronic key card read/write unit 4110; and the I/F 4111 is connected with a remote control signal transmitting unit 4112.

An operation instruction inputted from a user via the key operating unit 4108 is supplied to the control unit 4100 via the I/F 4107. In response to the instruction input from the user, the control unit 4100 controls the remote control signal transmitting unit 4112 via the interface 4111 to transmit an infrared remote control signal corresponding to the instruction input from the user from the remote control signal transmitting unit 4112.

As described above, the control unit 4100 of the remote control 41 reads necessary information such as personal ID and the like from the electronic key card 1 loaded in the slot of the remote control 41 via the electronic key card read/write unit 4110 and transmits the information in a state of being included in a remote control signal for transmission to the TV set 4.

Thus, the remote control 41 of the TV set 4 used in the third embodiment can form and send a remote control signal corresponding to an instruction input from a user, include, in a remote control signal to be sent, information such as personal ID and the like read from the electronic key card 1 loaded in the remote control 41, and then transmit the remote control signal.

[Operation of the TV Set 4 Receiving Remote Control Signals]

Receiving a remote control signal including information such as personal ID and the like as described above, the TV set 4 controls parts of the TV set 4 in response to the received remote control signal to perform various operations such as changing a selected channel, adjusting sound volume, and the like according to an instruction, which is provided via the remote control signal, from a user.

Further, receiving the remote control signal, the control unit 420 of the TV set 4 forms notification data including a destination ID (the device ID of the controlling apparatus main unit 2), the device ID of the TV set 4, the personal ID read from the loaded electronic key card, and the instruction received via the key operating unit 4108. Then, the control unit 420 transmits the notification data to the controlling apparatus main unit 2 via a digital interface 412 and a digital input/output terminal 411.

The notification data from the TV set 4 is supplied to the controlling apparatus main unit 2 via the router 5. Thereby the controlling apparatus main unit 2 knows quickly and correctly who has given what operating instruction to the TV set in which room.

Hence, when the TV set 4 is turned on via the remote control 41 and when channel change, sound volume adjustment, and the like are performed via the remote control 41, it is possible to identify the operator by the personal ID included in the remote control signals and confirm that the operator is present in the room where the TV set operated by the operator is installed.

Each time notification data including personal ID included in a remote control signal is transmitted from the TV set 4, the controlling apparatus main unit 2 refers to the room presence monitoring information described with reference to FIG. 6. The main unit 2 performs room presence registration when personal ID for which room presence registration has not been performed is transmitted.

In the third embodiment, in a case where room presence in another room is already registered at the time of performing room presence registration, the previous room presence registration is cancelled. It is thereby possible to register the leaving of the room simultaneously and thus monitor room presence of users properly.

[Time Shift Viewing of a Broadcast Program in the Third Embodiment]

The home network system according to the third embodiment enables time shift viewing as in the case of time shift viewing in the first embodiment as represented in FIG. 12.

Specifically, in the home network system according to the third embodiment, the determination of whether occurrence of movement of the user at the step S205 is detected is according to whether a remote control signal indicating pressing of a predetermined operating key such as a reproduction pause key or the like is received.

As for the determination of whether a destination of the user who has given the instruction for reproduction at the step S208 is detected, a remote control signal, which includes the personal ID of the user, corresponding to a predetermined key operation for clearing the reproduction pause is transmitted in the same room where the instruction for a reproduction pause was given. Then, notification data indicating this is transmitted from the TV set 4 in the room to the controlling apparatus main unit 2, and then the controlling apparatus main unit 2 captures the notification data. As a result, the controlling apparatus main unit 2 determines the detection of a destination of the user.

Also, it is possible to determine that the destination of the user is detected when a remote control signal, which includes the personal ID of the user, corresponding to a key operation for turning on the TV set 4 or changing the channel is transmitted in a room different from the room where the instruction for a reproduction pause was given, notification data indicating this is transmitted from the TV set 4 in the room to the controlling apparatus main unit 2, and then the controlling apparatus main unit 2 captures the notification data.

That is, by transmitting the personal ID of the holder of the electronic key card 1 to the controlling apparatus main unit 2, it is possible to properly manage the room presence monitoring information and properly detect the occurrence of movement of the user and the destination of the user. More specifically, the personal ID of the holder who is an operator of the remote control 41A, 41B, 41C, or 41D, is transmitted to the main unit 2 via the router 5, the TV set 4A, 4B, 4C, or 4D installed in each room, and the remote control 41A, 41B, 41C, or 41D for the TV set 4A, 4B, 4C, or 4D respectively. Thus, so-called time shift viewing of a broadcast program is realized in both the cases where the user does not change the room (the case where the user returns to the original room) and where the user changes the room (the case where the user moves to a different room).

Further, by replacing the hard disk device 3 shown in FIG. 18 with a DVD player 7, it is possible to transfer data reproduced from the DVD player 7 to the destination of the user, as in the case of the home network system according to the second embodiment described above with reference to FIGS. 13 to 17.

Also in this case, it is possible to determine whether occurrence of movement of the user is detected at the step S303, the step S403, and the step S503 in the flowcharts of FIG. 15, FIG. 16, and FIG. 17 according to whether a remote control signal indicating pressing of a predetermined operating key such as a reproduction pause key or the like is received.

As for the determination of whether a destination of the user who has moved is detected at the step S305, the step S405, and the step S505 in the flowcharts of FIG. 15, FIG. 16, and FIG. 17, for example, a remote control signal, which includes the personal ID of the user, corresponding to a predetermined key operation for clearing the reproduction pause is transmitted in the same room where the instruction for a reproduction pause was given. Then, notification data (data including a device ID at a destination of the data, a device ID of the transmitter, and the personal. ID) indicating this is transmitted from the TV set in the room to the controlling apparatus main unit 2.

Also, it is possible to detect the destination of the user when a remote control signal, which includes the personal ID of the user, corresponding to a key operation for turning on the TV set 4 or changing the channel is transmitted in a room different from the room where the instruction for a reproduction pause was given, and then, notification data (data including a device ID at a destination of the data, a device ID of the transmitter, and the personal ID) indicating this is transmitted from the TV set in the room to the controlling apparatus main unit 2.

That is, by transmitting the personal ID of the holder of the electronic key card 1 and the device ID of a TV set to the controlling apparatus main unit 2, it is possible to properly manage the room presence monitoring information and properly detect the occurrence of movement of the user and the destination of the user. More specifically, the personal ID of the holder who is an operator of the remote control 41A, 41B, 41C, or 41D, is transmitted to the controlling apparatus main unit 2 via the router 5, the TV set 4A, 4B, 4C, or 4D installed in each room, and the remote control 41A, 41B, 41C, or 41D for the TV set 4A, 4B, 4C, or 4D respectively. Thus, transfer of data reproduced from the DVD player 7 to the destination is realized in both the cases where the user does not change the room (the case where the user returns to the original room) and where the user changes the room (the case where the user moves to a different room).

When both the hard disk device 3 and the DVD player 7 are provided, it is possible to support both the hard disk device 3 and the DVD player 7 to enable time shift viewing and transfer of reproduced data according to the device reproducing the contents. Of course, the present invention is not limited to cases of using the hard disk device and the DVD player the present invention is applicable to cases of using various recording and reproducing devices and reproducing devices.

In addition, while in the foregoing third embodiment, information such as the personal ID of an operator and the like is transmitted to the controlling apparatus main unit 2 via the remote control 41A, 41B, 41C, or 41D of the TV set 4A, 4B, 4C, or 4D installed in each room, the present invention is not limited to this. A slot for an electronic key card may be provided for a remote control of the hard disk device 3, the DVD player 7, and the controlling apparatus main unit 2 to read information such as personal ID and the like and transmit the information in a state of being included in a remote control signal, so that a device receiving the remote control signal transmits notification information including the personal ID and a command corresponding to an operation input to the controlling apparatus main unit 2 to allow time shift viewing and transfer of reproduced data.

Further, when the entering and leaving of a room is detected and registered using a remote control of an electronic device used in each room, the registration of the entering and leaving of a room may be managed by always sending a room entering registration request of a remote control signal including personal ID when a electronic key card 1 is loaded into the remote control, for example, and always sending a room leaving registration request of a remote control signal including personal ID when a electronic key card 1 is extracted from the remote control, for example.

Further, instead of loading a electronic key card into a remote control, when each member of the family uses a remote control, for example, identifying information such as personal ID of the member can be inputted via the key operating unit to be temporarily stored in a memory within the remote control and then used.

[Other Means for Detecting and Registering the Entering and Leaving of Rooms]

The entering and leaving of a room of a user is detected by reading information from an electronic key card by action of electromagnetic induction by the read/write unit of a transmitting and receiving unit in the foregoing first and second embodiments and by transmitting personal ID in a state of being included in a remote control signal from a remote control of an electronic device and then transmitting the personal ID from the electronic device such as a TV set or the like to the controlling apparatus main unit 2 in the foregoing third embodiment. However, the present invention is not limited to these.

In the example of the home network system of the configuration shown in FIG. 1 and FIG. 2, a short-range radio communication technology such as Bluetooth, for example, is used, and a electronic key card 1 and transmitting and receiving units 21A to 21E are provided with a radio communication unit (a radio transmitting unit and a radio receiving unit). Then, for example, while a user is present in a room, the electronic key card 1 transmits personal ID in predetermined timing to communicate with the transmitting and receiving unit 21A to 21D of the room the user has entered, whereby the entering and leaving of rooms can be detected without the need for an operation of holding the electronic key card 1 to the transmitting and receiving units 21A to 21E or the like.

In this case, measures are taken to use very weak radio waves or prevent leakage of various radio waves from each room, for example, so that an electronic key card does not communicate with a transmitting and receiving unit in an adjacent room. Thereby the user can register the entering or leaving of a room without performing any operation to perform time shift viewing of a broadcast program and transfer of reproduced contents to a destination.

Further, in this case, a transmitting and receiving unit does not necessarily need to be provided at a door portion of each room; for example, it suffices to dispose a transmitting and receiving unit at a position allowing good radio communication between the transmitting and receiving unit and an electronic key card carried by a user who has entered the room, such for example as a ceiling portion of each room.

In the first and second embodiments, occurrence of movement of a user and a destination of the user are detected via a transmitting and receiving unit connected to the controlling apparatus main unit 2, while in the third embodiment, occurrence of movement of a user and a destination of the user are detected on the basis of a personal ID from the remote control 41 of a TV set 4.

Instead of thus using one of the alternatives at all times, both the alternatives may be incorporated into one home network system so that occurrence of movement of a user and a destination of the user are detected via a transmitting and receiving unit connected to the controlling apparatus main unit 2 and via a remote control signal from the remote control of an electronic device such as the TV set 4 installed in each room or the like. Of course, occurrence of movement of a user and a destination of the user may be detected by radio communication using the above-mentioned short-range radio communication technology.

While the foregoing embodiments have been described above by taking as an example a case of using contents involving video and audio such as DVD contents of a television broadcast program or a movie or the like, usable contents are not necessarily limited to those involving video and audio. It is of course possible to use only either one of video and audio.

Further, while the foregoing embodiments have been described above by taking as an example a case of installing a TV set in each room, the present invention is not limited to this. For example, a personal computer can be installed in each room and connected to the Internet via the router 5 and the ADSL modem 6 to transmit and receive electronic mail, download and execute various contents, and the like.

It is further possible to install a personal computer having a function of receiving television broadcast in each room and use a hard disk device included in the personal computer to enable so-called time shift viewing in any room and enable time shift viewing of a broadcast signal received and selected for reproduction in any room, or a broadcast signal viewed in any room even after movement to any room by using the invention described above.

Further, the foregoing embodiments have been described above by taking as an example a case where for time shift viewing, a broadcast signal is recorded on the hard disk device from the beginning and the recorded broadcast signal is reproduced. However, the present invention is not limited to this. For example, an operation of pressing a time shift key of a remote control is performed to leave a room, for example, and the broadcast signal is recorded on the hard disk from a point in time when a remote control signal corresponding to the operation is received.

When the user who left the room thereafter returns and performs the operation of pressing the time shift key again and a remote control signal corresponding to this operation is received, the recording of the broadcast signal is continued as it is, and the broadcast signal recorded on the hard disk from the immediately preceding recording start point is read and reproduced, whereby time shift viewing can be realized.

Also in this case, by transferring the read broadcast signal to an electronic device at a destination of movement of the user, it is possible to support time shift viewing in a different room without recording the broadcast signal from the beginning.

Further, in the foregoing embodiments, authentication is performed when a user holds an electronic key card to the transmitting and receiving unit 21E disposed at the entrance part, and when the user is authenticated, the door lock is released and the house presence/house absence flag is updated. However, the present invention is not limited to this.

For example, authentication is performed when a user holds an electronic key card to the transmitting and receiving unit 21E disposed at the entrance part, and when the user is authenticated, the door lock is released. Thereafter, when the user holds the electronic key card to the transmitting and receiving unit 21A to 21D in one of the rooms and the person is identified by personal ID, it is determined that there is a person present in the house, and the house presence/house absence flag is updated. That is, the user may be identified as a person present in the house after being checked at least twice.

As described above, according to the present invention, it is possible to monitor a state of room presence of a user within a predetermined house, correctly detect occurrence of movement of the user and a destination of the user, and automatically enable use of contents being used even at the destination. That is, processing for time shift viewing in a different room, transfer of reproduced data, or the like can be performed substantially automatically without requiring complicated operation, and reproduced information of contents, for example video and audio can be made to follow the movement of the user.

What is claimed is:

1. A device controlling apparatus comprising:

communication means for communicating with a plurality of electronic terminals;

state detection means for detecting a state of a user using content at a first electronic terminal;

state change detection means for detecting a state change from said first electronic terminal to a second electronic terminal;

storage means for storing a reproduction position of said content being used at said first electronic terminal, when said state change detection means detects said state change; and control means for controlling said first electronic terminal and said second electronic terminal, to use said content at said second electronic terminal from said reproduction position of said content stored in said storage means.

2. A device controlling method comprising:

a communication step for communicating with a plurality of electronic terminals;

a state detection step for detecting a state of a user using content at a first electronic terminal;

a state change detection step for detecting a state change from said first electronic terminal to a second electronic terminal;

a storing step for storing a reproduction position of said content being used at said first electronic terminal in storage means, when said state change is detected; and a control step for controlling said first electronic terminal and said second electronic terminal, to use said content at said second electronic terminal from said reproduction position of said content stored in said storage means.

* * * * *